US005242781A

United States Patent [19]

Ohbayashi et al.

[11] Patent Number: 5,242,781

[45] Date of Patent: Sep. 7, 1993

[54] DYE IMAGE RECEIVING MATERIAL WITH POLYMER PARTICLES

[75] Inventors: Keiji Ohbayashi; Masaru Tsuchiya, both of Tokyo, Japan

[73] Assignee: Konica Corporation, Tokyo, Japan

[21] Appl. No.: 749,560

[22] Filed: Aug. 26, 1991

[51] Int. Cl.[5] ..... G03C 5/54

[52] U.S. Cl. ..... 430/203; 430/213; 430/262; 430/263; 430/941

[58] Field of Search ..... 430/201, 203, 215, 262, 430/263, 941, 213

[56] References Cited

U.S. PATENT DOCUMENTS

| | | | |
|---|---|---|---|
| 3,958,995 | 5/1976 | Campbell et al. | 430/213 |
| 4,952,479 | 8/1990 | Aono et al. | 430/203 |
| 5,116,716 | 5/1992 | Komamura et al. | 430/203 |
| 5,135,835 | 8/1992 | Aono et al. | 430/203 |

FOREIGN PATENT DOCUMENTS

| | | |
|---|---|---|
| 59-124332 | 7/1984 | Japan . |
| 60-19138 | 1/1985 | Japan . |
| 60-60643 | 4/1985 | Japan . |
| 60-119557 | 6/1985 | Japan . |
| 60-122940 | 7/1985 | Japan . |
| 60-122942 | 7/1985 | Japan . |
| 61-156045 | 7/1986 | Japan . |
| 62-245257 | 10/1987 | Japan . |

*Primary Examiner*—Richard L. Schilling

*Attorney, Agent, or Firm*—Frishauf, Holtz, Goodman & Woodward

[57] ABSTRACT

A process of forming images with a heat-developable color light-sensitive material is disclosed. The process of forming images comprises steps of exposing image-wise a heat-developable color light-sensitive material which comprises a support having thereon a light-sensitive layer containing a binder, light-sensitive silver halide emulsion and dye donating substance capable of forming or releasing a diffusible dye upon heat development and superposing a dye image receiving material which comprises a support having thereon a dye receiving layer, over the light-sensitive material during, or after completion of, heat development to transfer dye images to said dye image receiving layer; wherein the dye image receiving layer contains a hydrophilic binder and polymer particles; a weight ration of the hydrophilic binder to the polymer particles is from 1:05 to 1:20; and the heat development and transfer of dye images to the dye image receiving layer are carried out in the substantial absence of water.

12 Claims, No Drawings

DYE IMAGE RECEIVING MATERIAL WITH POLYMER PARTICLES

BACKGROUND OF THE INVENTION

The present invention relates to a dye image receiving material and a method of forming images with said dye image receiving material, particularly to a dye image receiving material used in a heat developable color light-sensitive material or in the thermal image transfer method as well as a method of forming images with said dye image receiving material.

Heat development, in which the developing process is thermally carried out, is known in the art as a means to obtain black-and-white or color images. Also, a heat developable light-sensitive material of so-called transfer type, in which images obtained by heat-developing are transferred from a light-sensitive material to an image receiving layer, is well known.

In general, a heat developable color light-sensitive material has on a support at least one light-sensitive layer containing a binder, light-sensitive silver halide emulsion, dye donating material and reducing agent, and organic silver salts and other photographic additives may be added thereto according to a specific requirement. In a heat developable color light-sensitive material of transfer type, an image receiving material having an image receiving layer capable of receiving dyes is used in combination with the above light-sensitive material.

The present invention particularly relates to an image receiving material preferably used in combination with such a heat developable color light-sensitive material.

The dye image receiving material is conventionally divided into two main groups: one is an image receiving material whose image receiving layer consists of a heat-resistant hydrophobic polymer, and the other is an image receiving material whose image receiving layer consists of a hydrophilic binder containing a dye mordant, as described in Japanese Pat. O.P.I. Pub. Nos. 60643/1985, 119557/1985, 122942/1985, 122940/1985, 122941/1985, etc.

The former utilizes the high dyeing capability of a hydrophobic polymer; therefore, the binder has a dye receptivity in itself. Typical examples of such hydrophobic polymers include polyvinyl chloride described in Japanese Pat. O.P.I. Pub. No. 60643/1985, polyester described in Japanese Pat. O.P.I. Pub. No. 124332/1984 and polycarbonate disclosed in Japanese Pat. O.P.I. Pub. No. 19138/1985. Though these image receiving materials having an image receiving layer composed of such a hydrophobic polymer are high in dye receptivity, they have a drawback, because of the hydrophobic polymer's thermoplasticity, that the image receiving layer is thermally affected to cause a film break in a heat developing process carried out under a high temperature condition, and thereby uneven developing tends to occur. To remove such a drawback, there has been attempted to employ a thermoplastic resin of high heat resistance. This provides an image receiving layer of improved heat resistance, but cannot avoid a lowering of dye receiving capability.

In a dye image receiving material having an image receiving layer composed of a hydrophilic binder containing mordants, a color light-sensitive material is generally composed of a hydrophilic binder. Therefore, a special care is required in peeling a dye image receiving material from a light-sensitive material after heat development. In other words, since heat developing and dye transfer take place in the substantial absence of water, a light-sensitive material and an image receiving material must be closely contacted with each other. This necessitates use of a large amount of suitable thermal solvents. But such a thermal solvent has a tendency to disperse easily into a hydrophilic binder, and when binders of both a light-sensitive material and an image receiving material are composed mainly of a hydrophilic binder, the thermal solvent is liable to hinder clear peeling between the image receiving material and the light-sensitive material after development, causing partial breaks of the light-sensitive layer and the image receiving layer.

In a system using such a light-sensitive material and image receiving material, it is known to carry out heat developing by supplying some quantity of water to a light-sensitive material and/or an image receiving material immediately before heat developing. In this case, the peeling property after heat developing can be improved, as compared with the case using a large quantity of a thermal solvent, by controlling the hardened degree of hydrophilic binders used in both the materials. But this has a drawback of being liable to cause peeling failures when the amount of water is small.

On the other hand, use of a polymer latex in an image receiving layer is already known in the art. Japanese Pat. O.P.I. Pub. No. 156045/1986 discloses addition of a hydrophilic binder, mordant and polymer latex for preventing an image receiving layer from cracking.

In that invention, however, the function of a polymer latex is limited to prevention of layer cracking, and the peeling property between a light-sensitive material and an image receiving material after heat developing is not improved. Further, though Japanese Pat. O.P.I. Pub. No. 245257/1987 discloses application of a polymer latex on a dye mordant layer as a preventive measure against layer cracking, this is also ineffective in solving the above problem like the foregoing prior art.

SUMMARY OF THE INVENTION

A first object of the present invention is to solve the above problem, particularly to provide a dye image receiving material free from uneven development and capable of giving a high dye density and a method of forming dye images therewith, by improving the peeling property between a color heat developing light-sensitive material and an image receiving material after they are subjected to heat developing.

A second object of the present invention is to provide, in the method of dye transfer by sublimation, a dye image receiving material capable of giving a high density and free from melt-adhering to ink sheets and a method of forming images therewith.

A third object of the present invention is to provide an image receiving material low in, or free from, devitrification of coated films.

The above objects of the invention are attained by a dye image receiving material having, on a support, at least one dye image receiving layer containing at least a hydrophilic binder and polymer particles, wherein the weight ratio of said binder to said polymer particles is 1:0.5 to 1:20.

Further, the above objects of the invention are attained by a method of forming images which comprises the steps of exposing imagewise a heat developable color lightsensitive material having, on a support, at least one lightsensitive layer containing a binder, light-sensitive silver halide emulsion and dye donating substance capable of forming or releasing a diffusible dye upon heat development, and superposing a dye image receiving material having, on another support, at least one dye image receiving layer over the light-sensitive material during, or after completion of, heat development to transfer dye images to said dye image receiving layer, wherein said dye image receiving layer contains at least a hydrophilic binder and polymer particles, the weight ratio of said hydrophilic binder to said polymer particles is 1:0.5 to 1:20, and the heat development and transfer of dye images to said dye image receiving layer are carried out in the substantial absence of water.

Moreover, the above objects of the invention are attained by a method of forming dye images which comprises the steps of superposing a dye thermal-transfer recording sheet having a binder and yellow dye, magenta dye or cyan dye separately on a support over a dye image receiving material having at least one dye image receiving layer on another support, and transferring the dye from the dye thermal-transfer recording sheet to the dye image receiving material by heating imagewises with a thermal head, wherein said dye image receiving layer contains at least one hydrophilic binder and hydrophobic polymer particles, the weight ratio of said hydrophilic binder to said polymer particles is 1:0.5 to 1:20, and said transfer of the dye images to said dye image receiving layer are carried out in the substantial absence of water.

DETAILED DESCRIPTION OF THE INVENTION

The constitution of the invention is hereunder described in detail.

The dye image receiving material of the invention is basically composed of a support and at least one dye image receiving layer provided thereon, and said dye image receiving layer is composed at least of one hydrophilic binder and polymer particles.

The polymer particles used in the image receiving layer of the invention preferably have a glass transition point of not lower than 40° C.

The polymer particles include so-called polymer lattices prepared by emulsion polymerization or fine resin particles prepared by mechanically pulverizing a resin consisting of hydrophobic polymer and dispersing it in a hydrophilic colloidal medium, but polymer lattices are preferably used in the invention for their high stability.

Preferred polymer lattices are aqueous dispersions of polymers, which are divided into two main groups of condensation polymers and vinyl polymers. Examples of the condensation polymer include polyamides, polypeptides, polyesters, polycarbonates, polyacid-anhydrides, polyurethanes, polyureas and polyethers. The vinyl polymers are addition polymers based on vinyl groups including single polymers or copolymers of aliphatic hydrocarbon type, aromatic type, vinyl alcohol type, nitrile type, acrylic type, methacrylic typ, acrylonitrile type and halide type.

Among them, polyesters or vinyl polymers are preferably used since these can be easily manufactured. Polymerizable unsaturated compounds as raw materials of these vinyl polymers may be polymerizable unsaturated ethylenic compounds or diolefine compounds, such as acrylic acid and esters thereof, mathacrylic acid and esters thereof, crotonic acid and esters thereof, vinyl esters, maleic acid and diesters thereof, fumaric acid and diesters thereof, itaconic acid and diesters thereof, olefines, styrenes, acrylamides, methacrylamides, allyl compounds, vinyl ethers, vinyl ketones, polyfunctional monomers, vinyl heterocyclic compounds, glycidyl esters and unsaturated nitriles.

Among these polymerizable unsaturated compounds, examples of the acrylates include methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate 2-ethyoxyethyl acrylate, 2-isopropoxy acrylate, 2-butoxyethyl acrylate, 2-(2-methoxyethoxy)ethyl acrylate, 2-(2-butoxyethoxy)ethyl acrylate, w-methoxypolyethylene glycol acrylate (number of addition moles n: 9), 1-bromo-2methoxyethyl acrylate, 1,1-dichloromethoxyethyl acrylate and 1,1-dichloro-2-ethoxyethyl acrylate.

Examples of the methacrylates include methyl methacrylate, ethyl methacrylate, n-propyl methacrylate, isopropyl methacrylate, n-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, diethylene glycol monomethacrylate, 2-methoxyethyl methacrylate, 3-methoxybutyl methacrylate, 2-acetoxyethyl methacrylate, 2-acetacetoxyethyl methacrylate, 2-ethoxyethyl methacrylate, 2-iso-propoxyethyl methacrylate, 2-butoxyethyl methacrylate, 2-(-methoxyethoxy)ethyl methacrylate and w-methoxypolyethylene glycol methacrylate (number of addition moles n: 6).

Examples of the vinyl esters are vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate.

Examples of the olefines include dicyclopentadiene, ethylene, propylene, 1-butene, 1-pentene, vinyl chloride, vinylidene chloride, isoprene, chloroprene, butadiene and 2,3-dimethydutadiene.

Examples of the styrenes include styrene, methylstyrene, dimethylstyrene, trimethylstyrene, ethylstyrene, isopropylstyrene, chloromethylstyrtene, methoxystyrene, acetoxystyrtene, chlorostyrene, dichlorostyrene, bromostyrene and methyl vinyl benzoate.

Examples of the crotonates include butyl crotonate and hexyl crotonate.

Examples of the diitaconates are dimethyl itaconate, diethyl itaconate and dibutyl itaconate.

Examples of the dimaleate include diethyl maleate, dimethyl maleate and dibutyl maleate.

Examples of the fumarates include diethyl fumarate, dimethyl fumarate and dibutyl fumarate.

Examples of the acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimetylacrylamide, diethylacrylamide, β-cyanoethylacrylamide and N-(2-acetacetoxyethyl)acrylamide.

Examples of the methacrylamides include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxyethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetacetoxyethyl)methacrylamide.

Examples of the allyl compounds include allyl acetate allyl caprate, allyl laurate and allyl benzoate.

Examples of the vinyl ethers include methyl vinyl ether, buty vinyl ether, hexyl vinyl ether, methoxyethyl vinyl ether and dimethylaminoethyl vinyl ether.

Examples of the vinyl ketones include methyl vinyl ketone, phenyl vinyl ketone and methoxyethyl vinyl ketone.

Examples of the vinyl heterocyclic compounds include vinylpyridine, N-vinylimidazole, N-vinyloxazolidone, N-vinyltriazole and N-vinylpyrrolidone.

Examples of the glycidyl esters are glycidyl acrylate and glycidyl methacrylate.

Examples of the unsaturated nitriles are acrylonitrile and methacrylonitrile.

Example of the polyfunctional monomer include divinylbenzene, methlenebisacrylamide and ethylene glycol dimethacrylate.

Further, other examples of the polymerizable unsaturated compounds are acrylic acid, methacrylic acid, itaconic acid, maleic acid; monoalkyl itaconates such as monomethyl itaconate, monoethyl itaconate, monobutyl itaconate; monoalkyl maleaates such as monomethyl maleate, monoethyl maleate, monobutyl maleate; citraconic acid, styrenesulfonic acid, vinylbenzylsulfonic acid; acryloyloxyalkylsulfonic acid such as acryloyloxymethylsulfonic acid, acryloyloxyethylsulfonic acid, acryloyloxypropylsulfonic acid; methacryloyloxyalkylsulfonic acid such as methacryloyloxymethylsulfonic acid, methacryloyloxyethylsulfonic acid, methacryloyloxypropylsulfonic acid; acrylamide alkylsulfonic acid such as 2-acrylamide-2-methylethanesulfonic acid, 2-acrylamide-2-methylpropanesulfonic acid, 2-acrylamide-2-methylbutanesulfonic acid; methacrylamide alkylsulfonic acid such as 2-methacrylamide-2-methylethanesulfonic acid, 2-methacrylamide-2-methylpropanesulfonic acid, 2-methacrylamide-2-methylbutanesulfonic acid; acryloyloxyalkyl phosphates such as acryloyloxyethyl phosphate, 3-acryloyloxypropyl-2-phosphate; methacryloyloxyalkyl phosphates such as methacryloyloxyethyl phosphate, 3-methacryloyloxypropyl-2-phosphate; and sodium 2-allyloxy-2-hydroxypropanesulfonate having two hydrophilic groups. These acids may be salts of alkali metals (for example, Na, K) or ammonium ion. Moreover, there may be used, as other polymerizable unsaturated compounds, crosslinking monomers described in U.S. Pat. Nos. 3,459,790, 3,438,708, 3,554,987, 4,215,195, 4,247,673 and Japanese Pat. O.P.I. Pub. No. 205735/1962. Typical examples of such crosslinking monomers are N-(2-acetacetoxyethyl)acrylamide and N-2-(2-acetaceoxyethoxy)ethyl acrylamide.

Preferred examples of the polymer, which constitutes the polymer latex of the invention, include polyvinyl chloride, polyesters, polymethyl acrylate, polyethyl acrylate, poly-n-butyl acrylate, ethyl acrylate-acrylic acid copolymer, vinylidene chloride-butyl acrylate copolymer, butyl acrylate-acrylic acid copolymer, vinyl acetate-butyl acrylate copolymer, vinyl acetate-ethyl acrylate copolymer and ethyl acrylate-2-acrylamide copolymer. These polymer lattices can be generally manufactured by polymerizing a monomer for hydrophobic polymer under vigorous stirring, in the presence of a hydrophilic-group-containing surfactant at a high concentration.

Details of the manufacture of these polymer lattices are given, for example, in "Experimental Methods of Polymer Syntheses" by T. Ohtsu and M. Kinoshita, published by Kagaku Dojin Sha (1975).

As surfactants used in the manufactue of polymer lattices according to the invention, conventional anionic, nonionic, cationic and amphoteric surfactants can be employed singly or in combination.

It is preferable that the dispersoid of the polymer latex used in the invention be a polymer having an average molecular weight of 50,000 and above, and especially 200,000 to 500,000. The particle size of the polymer latex used in the invention can be controlled by setting appropriate manufacturing conditions (monomer quantity, surfactant quantity, polymerization temperature, stirring rate, etc.) and the preferred is an aqueous dispersion of a polymer having an average particle size of 0.02 μm to 0.2 μm.

Suitable examples of the hydrophilic binder used in the dye image receiving layer of the invention are synthetic and natural polymeric substances shch as polyvinyl butyral, polyvinyl acetate, ethyl cellulose, polymethacrylate, polyvinyl alcohol, polyvinyl pyrrolidone, gelatin, gelatin derivatives including phthalated gelatin, cellulose derivatives, protein, starch and gum arabic. These binders can be used singly or in combination. Of them, gelatin is particularly preferred, and a combination of gelatin and a hydrophilic polymer such as polyvinylpyrrolidone or polyvinylalcohol is also preferred.

These binders are generally used in an amount of 0.05 g to 50 g, preferably in an amount of 0.2 g to 20 g per square meter of a support.

In the dye image receiving material of the invention, the ratio of the polymer particles to the hydrophilic binder has a great influence on the dye density and peeling property between the light-sensitive material and image receiving material after heat development, and therefore it is necessary that the weight ratio of the hydrophilic binder to the polymer particles be within a range from 1:05 to 1:20. When the hydrophilic binder is used in excess of twice the weight of the polymer particles, the polymer particles' dye receiving capability sharply drops, and the peeling property between the light-sensitive portion and image receiving portion after heat development is lowered when these are subjected to heat developing with a thermal solvent. On the other hand, the weight of the polymer particles exceeds twenty times the weight of the hydrophilic binder, a substantially high dye density is obtained, but heat resistance of the image receiving layer in heat development is deteriorated, and thereby uneven developing due to film breaking comes to be liable to occur.

The ratio of the hydrophilic binder to the polymer particles is preferably 1:1 to 1:10 wt % and especially 1:2 to 1:6 wt %.

The addition amount of the polymer particles is about 0.5 to 50 g and preferably 1 to 25 g per square meter of image receiving material.

In the invention, it is necessary that the degree of swell (water absorption amount) of the hydrophilic binder contained in the image receiving layer be generally less than 800 wt % and preferably less than 600 wt % at 30° C. In the above, the degree of swell is defined as the following weight ratio:

$$\text{Degree of swell} = 100 \times (W_A/W_B)$$

where $W_B$ is a quantity of the hydrophilic binder by weight (g/m$^2$) and $W_A$ is a quantity of water contained in the image receiving side of the image receiving material (g/m$^2$) when the image receiving material is immersed in water maintained at 30° C.

Setting the degree of swell to a level less than the specific value makes it possible to prevent the image receiving layer from breaking during heat development or thermal recording and from sticking which causes uneven developing or uneven image transferring.

To keep the degree of swell amount of the image receiving layer less than 800 wt % and preferably less than 600 wt % in water of 30° C., there are added in the image receiving layer a hydrophilic binder and a hardener capable of hardening the layer. In the invention, conventional photographic hardeners are favorably used. Examples thereof include hardeners of epoxy type, aldehyde type, vinylsulfone type, metal salts such as aluminium compounds and chromium compound, acryloyl type, halogen-substituted s-triazine type, ethyleneimine type, methanesulfonic acid type, N-methylol type and isocyanate type. Particularly preferred hardeners are of vinylsulfone type, epoxy type and aldehyde type.

Typical examples of the hardener preferably used in the invention are illustrated as follows:

The

HCHO H-1

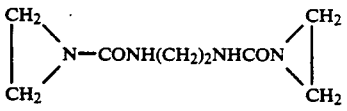
H-2

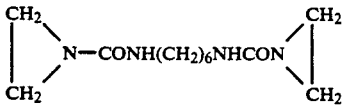
H-3

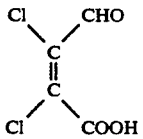
H-4

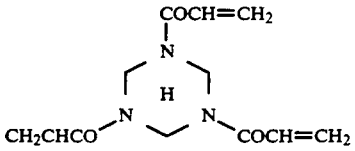
H-5

-continued

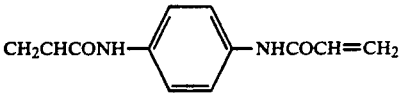
H-6

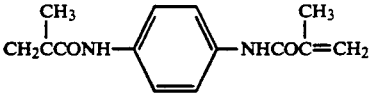
H-7

$C(CH_2SO_2CH{=}CH_2)_4$ H-8

$(CH_2{=}CHSO_2CH_2)_2O$ H-9

$(CH_2{=}CHSO_2CH_2CH_2)_2O$ H-10

$CH_2{=}CHSO_2CH_2CH(OH)CH_2SO_2CH{=}CH_2$ H-11 reaction product of $C(CH_2SO_2CH{=}CH_2)_4$ and $KO_3SCH_2CH_2NH_2$ in a molar ratio of 1:0.75 H-12

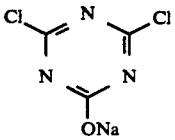
H-13

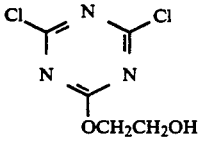
H-14

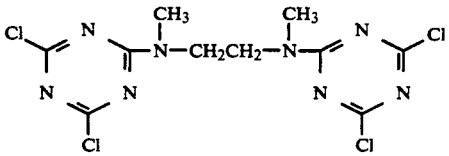
H-15

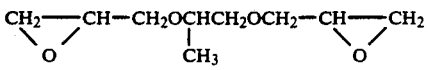
H-16

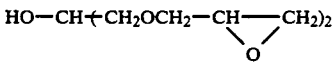
H-17

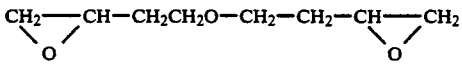
H-18

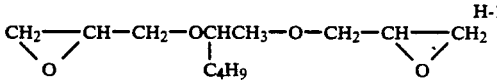
H-19

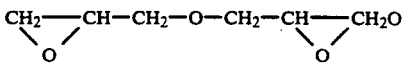
H-20

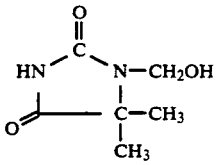
H-21

-continued $CH_3SO_2(CH_2)_3SO_2CH_3$ H-22

$CH_3SO_2CH_2CH_2OCH_2CH_2SO_2CH_3$ H-23

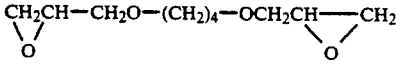
H-24

$CO(NHCH_2OH)_2$ H-25

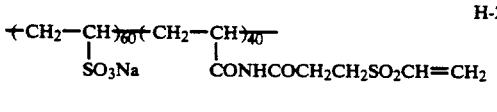
H-26

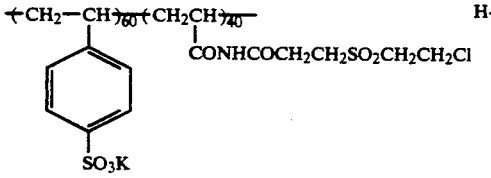
H-27

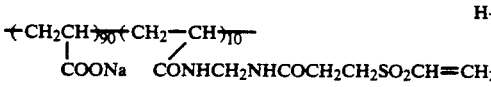
H-28

The addition amount of these hardeners varies depending upon kinds of hydrophilic binders, the weight ratio of the polymer particles to the hydrophilic binder, kinds of hardeners and properties of various additives contained in the image receiving layer. But it is generally 0.001 g to 0.2 g, preferably 0.01 g to 0.1 g per gram of hydrophilic binder.

For preventing devitrification of the dye image receiving layer, it is preferable that the dye image receiving layer of the invention contain a high boiling organic solvent having a boiling point higher than 170° C. Since the polymer particles used in the dye image receiving layer of the invention have relatively high glass transition points and the hydrophilic binder is present together with them, devitrification of film is liable to occur when they are made up into a dye image receiving layer. To prevent or control this, a high boiling organic solvent is favorably added in the image receiving layer.

Usable high boiling organic solvents can be arbitrarily selected from ones conventionally used for photography, but the preferred are those being liquid at room temperature and having a polar group such as ester group.

Typical examples of the high boiling organic solvent used in the invention are illustrated below.

Liquid paraffin (1)

Chlorinated paraffin (2)

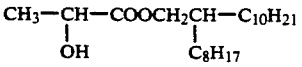
(3)

$CH_3-CHCOOC_{18}H_{37}$ (4)

-continued

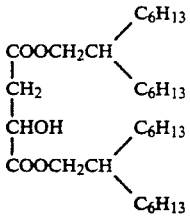
(5)

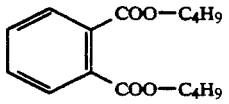
(6)

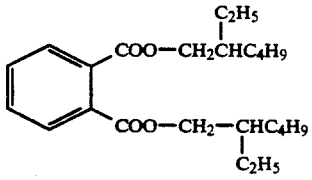
(7)

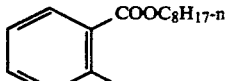
(8)

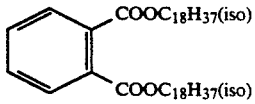
(9)

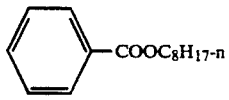
(10)

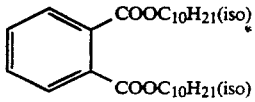
(11)

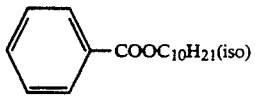
(12)

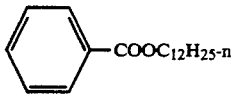
(13)

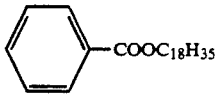
(14)

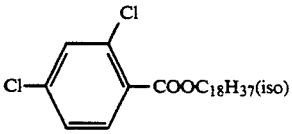
(15)

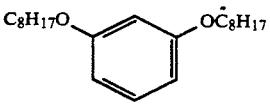
(16)

-continued

(17) $(C_4H_9O)_3P{=}O$

(18) 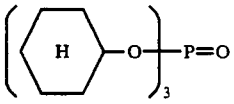

(19) $(C_8H_{17}O)_3P{=}O$

(20) $(iso\text{-}C_{10}H_{21})_3P{=}O$

(21) $(n\text{-}C_{16}H_{33}O)_3P{=}O$

(22) 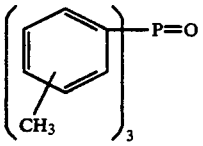

(23) 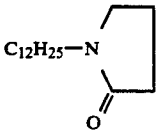

(24) 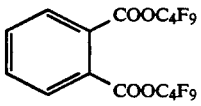

(25) 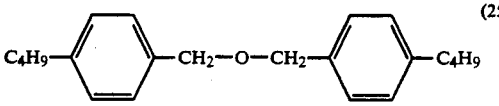

(26) $C_9H_{19}{-}O{-}C_9H_{19}$

(27) $C_4H_9COOC_2H_4OC_2H_4OCOCH_3$

(28) $C_4H_9COOC_2H_4OC_2H_4OCOC_4H_9$

(29) 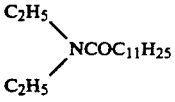

(30) 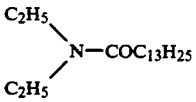

(31) 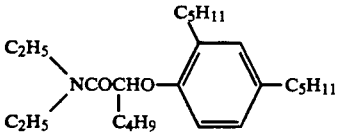

(32) 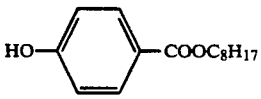

(33) 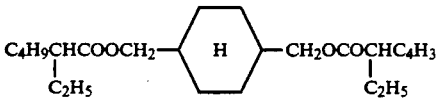

-continued

(34) $(C_2H_5O)_2{-}\underset{\underset{O}{\|}}{P}{-}(CH_2)_{10}COOC_5H_{11}(iso)$ These high boiling organic solvents are used in a range about from 1 to 100 wt %, preferably 5 to 50 wt % of the polymer particles.

In general, these high boiling organic solvents are emulsified in a hydrophilic colloidal aqueous solution before being added to a coating solution for image receiving layer. Besides the high boiling organic solvent, there may be added at this time a UV absorbent, image stabilizer, development controlling agent, or hydrophobic substances such as fluorescent brightener.

The image receiving layer of the image receiving material according to the invention may contain a conventional mordant within the limits not impairing the effect of the invention. As such mordants, there are preferably used those tertiary-amine- or quaternary-ammonium-salt-containing polymers which are described in U.S. Pat. No. 3,709,690 and Japanese Pat. O.P.I. Pub. No. 13546/1989. These mordants can be used in an amount less than 20 wt %, preferably less than 10 wt % of the polymer latex of the invention.

The support of the dye image receiving material of the invention may be either a transparent one or a reflective one. Suitable examples of the support include polyethylene terephthalate, polycarbonate, polystyrene, polyvinyl chloride, polypropylene, a support of the above plastic incorporated with a white pigment such as barium sulfate, calcium carbonate or titanium dioxide, art paper, cast-coated paper, baryta paper, paper laminated with a thermoplastic resin (e.g., polyethylene) containing a white pigment, cloths, glass, metal foil such as aluminium foil. Further, there may also be used in the invention a support obtained by coating and curing an electron-beam-curable resin composition on a support, and a reflective support having a second class diffusion reflectivity.

The dye image receiving material of the invention may be composed of a single dye image receiving layer, or may be provided with plural structural layers. In case plural layers are provided, all of the layers may be dye image receiving layers, or dye image receiving layers may be a portion of structural layers including a protective layer, subbing layer, etc.

The dye image receiving material of the invention may use conventional additives such as antistain agent, UV absorbent, fluorescent brightener, image stabilizer, developing accelerator, antifoggant, pH regulating agent (acid and acid precursor, base precursor, etc.), thermal solvent, organic fluoro-compound, oil droplets, surfactant, hardener, matting agent and various metal ions.

Next, the heat developable color light-sensitive material (hereinafter referred to as the heat developable color light-sensitive material of the invention) favorably used in combination with the dye image receiving material is described hereunder.

The heat developable color light-sensitive material of the invention has on a support at least one light-sensitive layer containing at least a binder, light-sensitive silver halide emulsion and dye donating substance capable of forming or releasing a diffusible dye upon heat development; further, a reducing agent or precursor thereof and an organic silver salt are contained therein when necessary.

Dye image donating substances usable in the heat developable color light-sensitive material of the invention include diffusible-dye-forming couplers described in Japanese Pat. O.P.I. Pub. Nos. 44737/1987, 129852/1987, 169158/1987, 200859/1989; leuco dyes described in Japanese Pat. O.P.I. Pub. No. 88254/1986; and azo dyes used in the heat developing dye bleaching method described in U.S. Pat. No. 4,235,957. The preferred are those dye-donating substances which form or release a diffusible dye, and the particularly preferred are those compounds which form a diffusible dye upon coupling reaction.

Next, the dye-donating substance, which is capable of forming or releasing a diffusible dye and favorably used in the invention, is hereunder described.

The dye-donating substance capable of forming or releasing a diffusible dye is required to correspond or reversely correspond to the reduction reaction of a light-sensitive silver halide and/or organic silver salt, and required to form or release a diffusible dye. It falls into a negative-type dye-donating substance and a positive-type dye-donating substance.

Examples of the negative-type dye-donating substance include reductive dye-releasing compounds described in U.S. Pat. Nos. 4,463,079, 4,439,513, Japanese Pat. O.P.I Pub. Nos. 60434/1984, 65839/1984, 71046/1984, 87450/1984, 88730/1984, 123837/1984, 124329/1984, 165054/1984 and 165055/1984.

Second examples of the negative-type dye donating substance are coupling-type dye-forming compounds described in U.S. Pat. No. 4,474,867, Japanese Pat. O.P.I Pub. Nos. 12431/1984, 48765/1984, 174834/1984, 159159/1984, 231040/1984 and 185630/1989.

Other preferable coupling-type dye-forming compounds of negative-type dye-donating substances are those represented by the following Formula (i).

Formula (i)

$$Cp—(J)—(B)$$

wherein Cp represents a coupler residue capable of forming a diffusible dye upon coupling with an oxidation product of a reducing agent, J represents a divalent organic group linking to Cp's coupling position at which reaction with the oxidation product of the reducing agent occurs, and B represents a ballast group. The term "ballast group" used here means a group which makes a dye donating substance non-diffusible during heat development; such a group includes, for example, a group having 8 or more, preferably 12 or more carbon atoms and a group having a diffusion-controlling effect depending upon the nature of the polymer chain or molecule (for example, sulfo group during heat development in the absence of water). The particularly preferred ballast group is a polymer chain.

Preferred coupling-type dye-donating substances, which have a polymer chain as a ballast group, are those having a polymer chain derived from a monomer represented by Formula (ii).

Formula (ii)

$$Cp—(J)—(Y)_l—(Z)—(L)$$

wherein Cp and J are the same as defined with Formula (i); Y represents an alkylene, arylene or aralkylene group; l represents 0 or 1; Z represents a divalent organic group; and L represents an ethylenic unsaturated group or a group having an ethylenic unsaturated group.

Typical examples of the coupling-type dye-forming compound represented by Formula (i) or (ii) include those described in Japanese Pat. O.P.I Pub. Nos. 124339/1984, 181345/1984, 2950/1895, 57943/1986, 59336/1986, 200859/1989, and U.S. Pat. Nos. 4,631,251, 4,650,743, 4,656,124. Of them, polymer-type dye-donating substances described in U.S. Pat. Nos. 4,656,124, 4,631,251 and 4,650,748 are preferred.

Examples of the positive-type dye-donating substance include those compounds which are described in Japanese Pat. O.P.I Pub. Nos. 55430/1984, 165054/1984, 15445/1984, 116655/1984, 124327/1984, 152440/1984, 13546/1989.

These dye-donating substances are used singly or in combination. The addition amount of these substances varies broadly depending upon kinds of dye-donating substances and uses of a heat developable light-sensitive material, but it is generally 0.05 to 10 g, preferably 0.1 to 5 g per square meter of the light-sensitive material.

These dye-donating substances are incorporated into a photographic component layer of the heat developable light-sensitive material by a method selected from the following: a method which emulsifies a dye donating substance in a hydrophilic colloid solution using conventional high boiling solvents such as dibutyl phthalate, dioctyl phthalate or tricresyl phosphate; a method which disperses a dye-donating substance by steps of dissolving it in a hydrophilic colloid alkaline aqueous solution, and then neutralizing the solution with an acid; and a method which mechanically disperses a dye-donating substance into solid particles in a hydrophilic colloid aqueous solution through a known means.

The light-sensitive silver halide used in the heat developable light-sensitive material of the invention may be any of conventional silver halides such as silver chloride, silver bromide, silver iodobromide, silver chlorobromide and silver chloroiodobromide.

These silver halides may have a uniform composition from inner portion to outer portion of grains; a core/shell structure different in composition from inner portion to outer portion of grains; or a step structure or a multi-layered structure in which composition change continuously.

There may be used either silver halide grains having a clear crystal habit, such as cube, sphere, octahedron, dodecahedron and tetradecahedron, or ones having no clear crystal habit. Further, there may also be used tabular silver halides described in Japanese Pat. O.P.I Pub. Nos. 111933/1983, 111934/1983 and Research Disclosure No. 22,534, of which grains have two parallel crystal faces larger than other crystal faces and a diameter to thickness ratio of about 5:1 or more.

Other usable ones are internal latent image-type silver halide emulsions having grain surfaces not fogged beforehand, which are described, for example, in U.S. Pat. Nos. 2,592,250, 3,220,613, 3,271,257, 3,317,322, 3,511,622, 3,531,291, 3,447,927, 3,761,266, 3,703,584, 3,736,140, 3,761,276 and Japanese Pat. O.P.I Pub. Nos. 8524/1975, 38525/1975, 15661/1977, 127549/1980.

In a grain growing process of these light-sensitive silver halides, metal ion seeds of iridium, gold, rhodium, iron or lead may be added in the form of salt.

The grain size of the above light-sensitive silver halide emulsion is generally about 0.02 to 2 μm, preferably about 0.05 to 0.5 μm.

In the invention, a light-sensitive silver halide may also be prepared by having light-sensitive-silver-halide-forming components coexist with the following organic silver salts to convert a portion of said organic silver salts into a light-sensitive silver halide.

The light-sensitive silver halide may be chemically sensitized on the grain surface using a conventional sensitizer (for example, active gelatin, inorganic sulfur, sodium thiosulfate, thiourea dioxide, sodium chloroaurate).

The chemical sensitization may also be carried out in the presence of a nitrogen-containing heterocyclic compound or a mercapto-group-containing heterocyclic compound.

Further, these light-sensitive silver halides may be subjected to spectral sensitization to blue, green, red and infrared lights with conventional spectrally sensitizing dyes. Typical sensitizing dyes are cyanines, merocyanines, tri-nuclear or tetra-nuclear cyanines, holopolar cyanines, styryl dyes, hemicyanines and oxonol. The addition amount of these sensitizing dyes is 1 μmol to 10 mols, preferably 10 μmol to 0.1 mol per mol of silver halide. The addition may be made in any process of a silver halide emulsion. To be concrete, it may be made during silver grain formation or in the course of removing soluble salts, or before chemical ripening, during chemical ripening or after completion of chemical ripening.

These light-sensitive silver halides and light-sensitive-silver-salt-forming compositions are used in an amount of about 0.01 to 50 g, preferably 0.1 to 10 g per square meter of light-sensitive material.

The heat developing light-sensitive material of the invention may use a conventional organic silver salt according to specific requirements for a high sensitivity and improved developing property.

Suitable organic silver salts in the invention include silver salts of long-chain aliphatic carboxylic acids and silver salts of heterocyclic carboxylic acids (for example, silver behenate, silver α-(1-phenyltetrazolethio)acetate) described in Japanese Pat. O.P.I Pub. Nos. 4921/1978, 52626/1974, 141222/1977, 36224/1978, 37626/1978, 37610/1978 and U.S. Pat. Nos. 3,330,633, 3,794,496, 4,105,451; silver salts of imino-group-containing compounds described in Japanese Pat. Exam. Pub. Nos. 26582/1969, 12700/1970, 18416/1970, 22815/1970, Japanese Pat. O.P.I Pub. Nos. 137321/1977, 118638/1983, 118639/1983 and U.S. Pat. No. 4,123,274; and acetylene silver described in Japanese Pat. O.P.I Pub. No. 249044/1987.

Of the above silver salts, silver salts of imino-group-containing compounds are preferred, and silver salts of benzotriazole and its derivatives (for example, benzotriazole silver, 5-methylbenzotriazole silver) are particularly preferred.

These organic silver salts may be used singly or in combination. These are prepared in an aqueous solution of a hydrophilic colloid such as gelatin, and after removal of soluble salts, they may be used as they are, or may be isolated, pulverized mechanically and dispersed into fine solid patricles before use. The amount of these organic silver to be used is 0.01 to 20 g, preferably 0.1 to 50 g per square meter of a light-sensitive material.

Reducing agents used in the heat developable light-sensitive material of the invention may be selected from conventional ones used in a heat developable light-sensitive material, by taking their developing mechanisms and dye forming or releasing mechanisms into consideration. The reducing agent mentioned here includes a reducing agent precursor which releases a reducing agent at the time of heat development.

Reducing agents usable in the invention are, for example, p-phenylenediamine-type and p-aminophenol-type developing agents, phosphoramidophenol-type developing agents, sulfonamidoaniline-type developing agents, phenols, sulfonamidophenols, polyhydroxybenzenes, naphthols, hydroxybisnaphthyls, methylenebisphenols, ascorbic acids, 1-aryl-3-pyrazolidone, hydrazone, and precursors of these reducing agents, which are described in U.S. Pat. Nos. 3,351,286, 3,761,270, 3,764,328, 3,342,599, 3,719,492, Research Disclosure Nos. 12,146, 15,108, 15,127 and Japanese Pat. O.P.I. Pub. Nos. 27132/1981, 135628/1978, 79035/1982.

Further, dye-donating substances may have a function of reducing agent.

Particularly preferred reducing agents are N-(p-N',N'-dialkylamino)phenylsulfamates and derivatives thereof.

These reducing agents are used singly, or in combination of two or more, in a range from 0.01 to 100 mmol per square meter of a light-sensitive material.

In order to accelerate transfer of dyes, the heat developable light-sensitive material of the invention preferably use thermal solvents. Thermal solvents are compounds which liquefies at the time of heat development to accelerate heat development and thermal-transfer of dyes, and it is preferable that these should be solid at the normal temperature.

Thermal solvents usable in the invention are those compounds which are described, for example, in U.S. Pat. Nos. 3,347,675, 3,667,959, 3,438,776, 3,666,477, Research Disclosure No. 17,643 and Japanese Pat. O.P.I. Pub. Nos. 19325/1976, 24829/1978, 60223/1978, 118640/183, 198038/1983, 229556/1984, 68730/1984, 84236/1984, 191251/1985, 232547/1985, 14241/1985, 52643/1986, 78554/1987, 42153/1987, 44737/1987, 53548/1988, 161446/1988, 224751/1989, 863/1990.

Typical examples of such thermal solvents include urea derivatives (for example, dimethyl urea, diethyl urea, phenyl urea), amide derivatives (for example, acetamide, stearylamide, benzamide, p-toluamide, p-acetoxyethoxybenzamide, p-butanoyloxyethoxybenzamide), sulfonamide derivatives (for example, p-toluenesulfonamide), polyhydric alcohols (for example, 1,6-hexane diol, pentaerythritol, polyethylene glycol).

Among the above thermal solvents, water-insoluble solid thermal solvents are particularly preferred, examples thereof include compounds described, for example, in Japanese Pat. O.P.I. Pub. Nos. 136645/1987, 139545/1987, 53548/1988, 161446/1988, 224751/1989, 863/1990, 120739/1990, 123354/1990.

The thermal solvent may be added in any layer such as light-sensitive silver halide emulsion layer, inter mediate layer, protective layer or dye image receiving layer of the image receiving member. The addition amount thereof is generally 10 to 500 wt %, and preferably 30 to 300 wt % of binder.

Binders usable in the heat developing light-sensitive material of the invention are synthetic or natural high molecular substances such as polyvinyl butyral, polyvinyl acetate, ethyl cellulose, polymethacrylate, polyvinyl alcohol, polyvinylpyrrolidone, gelatin, gelatin derivatives including phthalated gelatin, cellulose derivatives, proteins, starch and gum arabic. These can be used singly or in combination of two or more. Gelatin and its derivatives are preferably used in combination with a hydrophilic polymer such as polyvinylpyrrolidone or polyvinyl alcohol; a mixed binder of gelatin and polyvinylpyrrolidone is particularly preferred.

The addition amount of these binders is generally 0.05 to 50 g, preferably 0.2 to 20 g per square meter of support.

Besides the above compounds, the heat developable light-sensitive material of the invention can use various additives.

Developing accelerators useful in the invention are, for example, compounds described in Japanese Pat. O.P.I. Pub. Nos. 177550/1984, 111636/1984, 124333/1984, 72233/1986, 236548/1986 and 152454/1989. Further, there can also be used developing-accelerator-releasing compounds described in Japanese Pat. O.P.I. Pub. Nos. 159642/1986, 104645/1989 and Japanese Pat. Application No. 110767/1989; and metal ions having an electronegativity of 4 or more described in Japanese Pat. O.P.I. Pub. No. 104645/1989.

Antifoggants usable in the invention are, for example, higher fatty acids described in U.S. Pat. No. 3,645,738; mercuric salts described in Japanese Pat. Exam. Pub. No. 11113/1972; N-halogenated compounds described in Japanese Pat. O.P.I. Pub. No. 47419/1976; mercapto-compound-releasing compounds described in U.S. Pat. No. 3,700,457 and Japanese Pat. O.P.I. Pub. No. 50725/1976; arylsulfonic acid described ibid. No. 125016/1974; lithium carboxylates described ibid. No. 47419/1976; oxidizing agents described in British Pat. No. 1,455,271 -and Japanese Pat. O.P.I. Pub. No. 101019/1975; sulfonic acids and thiosulfonic acids described ibid. No. 19825/1978; thiouracils described ibid. No. 3223/1976: sulfur described ibid. No. 26019/1976; disulfides and polysulfides described ibid. Nos. 42529/1976, 81124/1976, 93149/1980; rosin and terpenes described ibid. 57435/1976; polymer acids having a carboxylic group or sulfonic group described ibid. 104338/1976; thiazolithiones described in U.S. Pat. 4,138,265; triazoles described in Japanese Pat. O.P.I. Pub. Nos. 51821/1979, 142331/1980, U.S. Pat. No. 4,137,079; thiosulfinates described in Japanese Pat. O.P.I. Pub. No. 140883/1980; di- or trihalides described ibid. 46641/1084, 57233/1984, 57234/1984; thiol compounds described ibid. 111636/1984; and hydroquinone derivatives described ibid. 198540/1985, 227255/1985. Other favorable antifoggants includes antifoggants having a hydrophilic group described in Japanese Pat. O.P.I. Pub. No. 78554/1987, polymer antifoggants described in Japanese Pat. O.P.I. Pub. No. 121452, and antifoggants having a ballast group described in Japanese Pat. O.P.I. Pub. No. 123456/1987. Further, colorless couplers described in Japanese Pat. O.P.I. Pub. No. 161239/1989 can be favorably used.

Base precursors usable in the invention are, for example, compounds which decarboxylate and release a basic compound on heating (guanidine trichloroacetate, etc.), compounds which decompose to release an amine by intramolecular nucleophilic substitution, and basic precursors which release a base through reaction between a sparingly water-soluble basic metal compound (zinc hydroxide, etc.) and a compound capable of forming a complex together with said metal compound (picolinic acid, etc.) Examples thereof can be seen, for example, in Japanese Pat. O.P.I. Pub. Nos. 130745/1981, 157637/1984, 166943/1984, 180537/1984, 174830/1984, 195237/1984, 108249/1987, 174745/1987, 187847/1987, 97942/1988, 96159/1988 and 68746/1989.

Besides the above compounds, the heat developable light-sensitive material of the invention can use various known photographic additives such as antihalation dye, colloidal silver, fluorescent brightener, hardener, antistatic agent, surfactant, inorganic or organic matting agent, antifading agent, UV absorbent and agent for adjusting white portion tone.

Typical examples of these additives are described in Research Disclosure, vol. 170, No. 17029 (June, 1978) and Japanese Pat. O.P.I. Pub. Nos. 135825/1987, 13546/1989.

These additives can be added not only in a light-sensitive layer but in any other component layer such as intermediate layer, subbing layer, protective layer or backing layer.

Supports usable in the heat developing light-sensitive material of the invention include, for example, glass; transparent or semi-transparent synthetic plastic films such polypropylene film, cellulose acetate film, polyethylene terephthalate film, polyethylene naphthalate film; coated papers shuch as art paper, cast-coated paper, baryta paper; polyethylene-coated paper; and supports prepared by coating and curing an electron-beam-curable resin composition on the above support.

The heat developable light-sensitive material of the invention contains (a) a light-sensitive silver halide emulsion, (b) a dye donating substance, (c) a binder, and preferably, contains further (d) an organic acid and (e) a reducing agent. These may be contained in a single photographic structural layer, or in two or more layers separately. To be concrete, there may be added components (a), (b), (c) and (d) in one layer and a component (e) in an adjacent layer, or components (a), (b), (c) and (e) in one layer and a component (d) in another layer.

Further, a light-sensitive layer having one and the same color sensitivity may be composed of two or more layers having a low sensitivity and a high sensitivity respectively.

When the heat developable light-sensitive material of the invention is made into a full-color recording material, three light sensitive layers different in color sensitivity are generally provided, so as to have respective layers form or release dyes different in color during heat development. Generally, in such a case, a yellow dye (Y) is combined with a blue-sensitive layer (B), a magenta dye (M) with a green sensitive layer (G), and a cyan dye (C) with a red-sensitive layer (R). However, the embodiment of the invention is not limited to this and can use any combination. For example, there can be used combinations of (B-C) - (G-M) - (R-Y) and (infrared sensitive-C) - (G-Y) - (R-M).

The layer configuration can be selected arbitrarily; there may be used, on a support, layer configurations of R-G-B, G-R-B, R-G-infrared, or G-R-infrared.

The heat developable light-sensitive material of the invention may have any of nonlight-sensitive layers such as subbing layer, intermediate layer, protective layer, filter layer, backing layer and peelable layer, in addition to the light-sensitive layer.

The heat developable light-sensitive material of the invention may be exposed with a conventional means appropriate to the color-sensitivity of the light-sensitive material.

As light sources to expose the light-sensitive material, a tungsten lamp, halogen lamp, xenon lamp, mercury lamp, CRT light source, OF-CRT light source, light emitting diode and laser beam, (for example, gas laser, dye laser, YAG laser, semiconductor laser, etc.) are used singly or in combination. A light source obtained by combination of a semiconductor laser and SHG element (2nd higher harmonic generation element) can be also used. Besides the above, exposure may be made with light emitted from a fluorescent substance excited by an electron beam, X-ray, γ-ray or α-ray.

Exposing time is different by cases whether exposure of one picture is made at a time or it is digitally carried out pixel by pixel. In the former case, the exposing time is generally 0.001 to 10 sec; in the latter case, it is in a range from $10^{-8}$ to $10^{-2}$ sec per pixel.

In exposing, a color filter may be used for adjustment of a light source's color temperature if necessary. Also, scanner exposing may be carried out with a laser or a like.

In forming color images, the heat developable light-sensitive material of the invention is exposed imagewise and then subjected to heat development, preferably at 70° to 200° C. and especially at 90° to 170° C., preferably for 1 to 180 sec and especially 2 to 120 sec. Transfer of diffusible dyes to the image receiving member may be made simultaneously with heat development, by contacting the image receiving layer of the image receiving member with the light-sensitive layer of the light-sensitive material. The transfer may also be made after heat developing, by contacting the image receiving member with the light-sensitive material.

The dye image formation by means of the thermal-transfer of the invention is carried out in the substantial absence of water. The term "in the substantial absence of water" used here means that the development is carried out under a condition where the moisture content of the light-sensitive material and image receiving material equilibrate with that of the ambient air, and that water is not applied thereto by coating or spraying.

Further, the light-sensitive material may be preheated in a temperature range from 70° to 160° C before exposure, or at least one of the light-sensitive material and image receiving member may be preheated in a temperature range from 80° to 120° C. immediately before developing as described in Japanese Pat. O.P.I. Pub. Nos. 143338/1985 and 162041/1986.

In heat development of the heat developable light-sensitive material of the invention, conventional heating means can be used. For example, there may be employed a method to contact the light-sensitive material with a heated block or surface heater, or a hot roller or hot drum; a method to pass the light-sensitive material through an atmosphere kept at a high temperature; a method to utilize high-frequency heating; or a method to utilize Joule's heat generated by applying an electric current to an exothermic conductive substance, such as carbon black, provided on the reverse side of the light-sensitive material or image receiving member.

The heating pattern in heat development is not particularly limited. There may be arbitrarily used a method to heat at a constant temperature; a method to carry out head development at a high temperature during the initial stage and at a low temperature after that, or a method to heat reversely to this; a method to change the temperature to three or more steps; or a method to change the temperature continuously.

When the image receiving material of the invention is employed as an image receiving material in the sublimation-type thermal-transfer method, it is used together with an ink sheet carrying on a support a cyan, a magenta and a yellow dye, and a single or a blended black dye if necessary. This method is described, for example, in Journal of the Electrophotographic Association, Vol. 27, No. 2 (1988), pp.365–371.

Dyes usable in the ink sheet include, for example, compounds described in Shikizai, Vol. 61, No. 4 (1988), pp.234–242.

As binders to hold dyes in the ink sheet, there may be used, for example, cellulose-type resins such as ethyl cellulose, hydroxyethyl cellulose, hydroxy cellulose, hydroxybutyl cellulose, cellulose acetate, cellulose butylate; and vinyl-type resins such as polyvinyl butyral, polyvinyl acetal, polyvinylpyrrolidone, polyacrylamide, polyester, polyphenylene oxide.

As supports which constitute the ink sheet, there may be used, for example, condenser paper, polyester film, polystyrene film, polysulfone film, polyimide film and cellophane. Particularly, polyethylene terephthalate film and polyethylene-2,6-dinaphthalate film are preferred.

To prevent a thermal head from adhering to the ink sheet during heating, a slipping layer is provided on the reverse side of the ink sheet. Lubricants and matting agents such as silica are used in the slipping layer.

EXAMPLES

Typical examples of the invention are described hereunder. As a matter of course, however, the scope of the invention is not limited to these examples.

Example 1

(1) Preparation of image receiving materials

Image receiving material 1 (comparative sample) was prepared by providing a dye image receiving layer having the following composition on a photographic baryta paper of 150 g/m2. Addition amounts are per square meter of material unless otherwise specified.

| (Composition of image receiving layer) | |
|---|---|
| Polyvinyl chloride (average polymerization degree: 500) | 10 g |
| Image stabilizer-1 | 0.7 g |
| Image stabilizer-2 | 0.5 g |
| Image stabilizer-3 | 0.3 g |
| Image stabilizer-4 | 0.8 g |
| Developing accelerator-1 | 0.5 g |

Coating of the image receiving layer was made by extrusion-coating of a coating solution having the above composition (solvent: methyl ethyl ketone).

Separately, image receiving material 2 was prepared by coating a dye receiving layer of the following composition on a baryta paper (coating was carried out using an aqueous coating solution of the following composition with a slide hopper coater).

| | |
|---|---|
| Gelatin | 4 g |
| Dye mordant-1 | 8 g |
| Image stabilizer-1 | 0.7 g |
| Image stabilizer-2 | 0.5 g |
| Image stabilizer-3 | 0.3 g |
| Image stabilizer-4 | 0.8 g |

-continued

| Developing accelerator-1 | 0.5 g |
|---|---|

Dye mordant-1

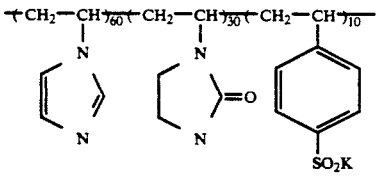

Image stabilizer-1

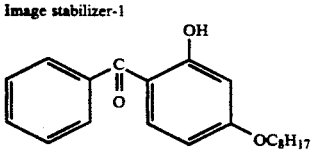

Image stabilizer-2

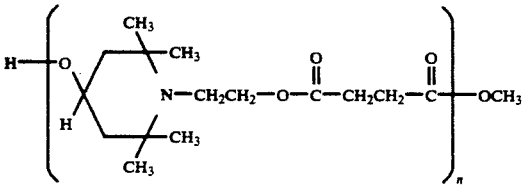

n ≈ 100

Image stabilizer-3

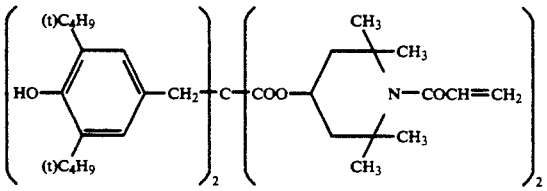

Image stabilizer-4

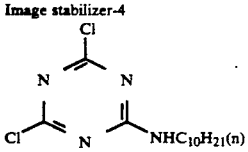

Developing accelerator-1

$(HOC_2H_4SCH_2)_2$

Next, image receiving materials 3 to 11 were prepared by coating on the above photographic baryta paper a polyvinyl chloride latex (glass transition point Tg:110° C.) and gelatin. In these image receiving materials 3 to 11, image stabilizers-1, -2, -3, -4 and developing accelerator were added in the image receiving layers in the same amount as in image receiving material-2. (coating was conducted in the same manner as in image receiving material-2.)

In image receiving materials 2 to 9, 0.01 g per gram gelatin of bisvinylsulfonylmethylmethane (hardener-1) was added to each image receiving layer for hardening.

The image receiving material prepared as above were preserved for 3 days at 35° C. and 60% RH for the completion of hardening.

(2) Preparation of heat developable light-sensitive materials

A heat developable color light-sensitive material was prepared by providing a layer configuration shown in Table 2 on a 180-μm-thick transparent polyethylene terephthalate film support subbed on both sides. In Table 2, addition amounts are per square meter of the heat developable light-sensitive material (but amounts of light-sensitive silver halide emulsions and benzotriazole silver salt are given in silver equivalents).

The heat developing light-sensitive material prepared as above was preserved for 5 days at 35° C. and 60% RH for hardening.

(3) Evaluation of image receiving materials

After exposing the light-sensitive material to a white light via an optical wedge, image receiving materials 1 to 11 were superposed thereon. Then, heat development was carried out under conditions of 150° C and 75 sec, with a drum belt-type heat developing apparatus, so as to obtain continuously 10 developed images each of respective image receiving materials.

Each sample was cooled to room temperature, and the peeling property was evaluated by peeling the image receiving material from the light sensitive material Also, the number of layer breaks and unevennesses caused by transfer failure were counted on each image receiving material after peeling. Separately, the reflection densities (maximum density and minimum density) of a dye image formed on the image receiving layer were measured as shown in Table 3. In the table, B, G and R in the columns of maximum density and minimum density mean that these densities were measured with monochromic lights of blue, green and red, respectively.

The peeling property was rated by the following criteria:

a: Readily peelable, and at the margins of a light sensitive material, the light-sensitive layer is not transferred to the image receiving layer at all.

b: Peeling is made relatively easily, but is less smooth at some portion, or a slight portion of the light-sensitive layer is transferred to the image receiving layer at the margins.

c: A fairly large force is required in peeling, and in almost all peeled materials, the light-sensitive layer is partly transferred to the image receiving layer.

d: Peeling is nearly impossible.

TABLE 1

| Image receiving material | Gelatin ($g/m^2$) | Polyvinyl chloride latex ($g/m^2$) |
|---|---|---|
| 3 (Comparison) | 12 | 0 |
| 4 (Comparison) | 9 | 3 |
| 5 (Invention) | 7 | 5 |
| 6 (Invention) | 6 | 6 |
| 7 (Invention) | 4 | 8 |
| 8 (Invention) | 2 | 10 |
| 9 (Invention) | 1.2 | 10.8 |
| 10 (Invention) | 0.6 | 11.4 |
| 11 (Comparison) | 0 | 12 |

As an infrared-sensitive, green-sensitive and red-sensitive emulsion, the following emulsions were used in the heat developable light-sensitive material. Infrared-sensitive silver iodobromide emulsion:

The average grain size was 0.15 μm (variation coefficient of grain size distribution: 8%), the silver iodide composition was 2 mol %, and the grain shape was of cube having slightly rounded corners and edges. Potassium hexachloroiridium (IV) was added in the course of grain formation, and chemical ripening was optimumly carried out in the presence of sodium thiosulfate, sodium chloroaurate, the following mercapto compound-1 and the following sensitizing dye (a).

Green-sensitive silver iodobromide emulsion

The average grain size was 0.25 μm (variation coefficient of grain size distribution: 9%), the silver iodide composition was 2 mol %, and the grain shape was of cube having slightly rounded corners and edges. Potassium hexachloroiridium (IV) was added in the course of grain formation, and chemical ripening was optimumly carried out in the presence of sodium thiosulfate, sodium chloroaurate, the following mercapto compound-1 and the following sensitizing dye (b).

Red-sensitive silver iodobromide emulsion

The average grain size was 0.15 μm (variation coefficient of grain size distribution: 8%), the silver iodide composition was 2 mol %, and the grain shape was of cube having slightly rounded corners and edges. Potassium hexachloroiridium (IV) was added in the course of grain formation, and chemical ripening was optimumly carried out in the presence of sodium thiosulfate and the following sensitizing dye (c).

To each of the above three light-sensitive silver halide emulsions, 1 g per mol silver halide of 4-hydro-6-methyl-1,3,3a,7-tetrazaindene was added after completion of the chemical sensitization.

Sensitizing dye (a)

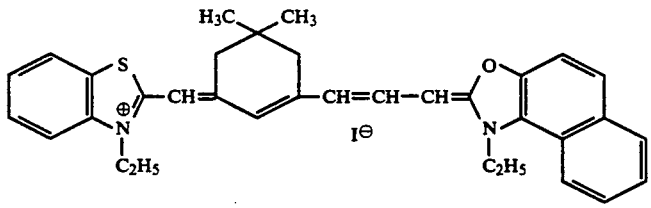

Sensitizing dye (b)

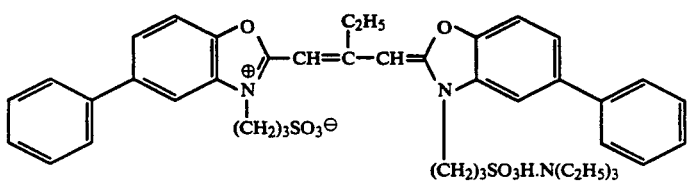

Sensitizing dye (c)

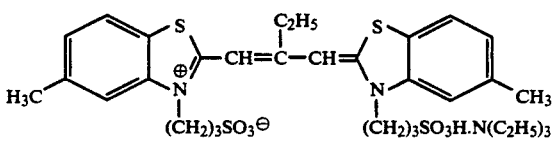

Silver benzotriazole emulsion

Prepared by mixing simultaneously an ammoniacal silver nitrate aqueous solution and bendotriazole (containing 0.2 mol % of aqueous ammonia per mol benzotriazole) into a 10%-aqueous solution of phenylcarbamoyl gelatin of 50° C. After completing the addition, the pH was reduced and then flocculation and desalting were carried out to obtain needle crystals (width: 0.1 to 0.2 μm, length: 0.5 to 2 μm).

Mercapto compound-1

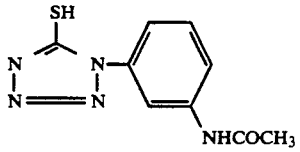

Dye donating substance (1)

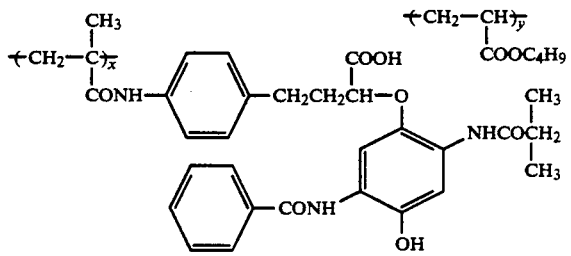

x = 60 wt %
y = 40 wt %

-continued
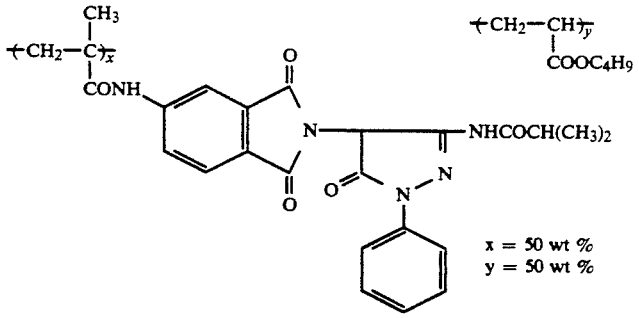
Dye donating substance (2)
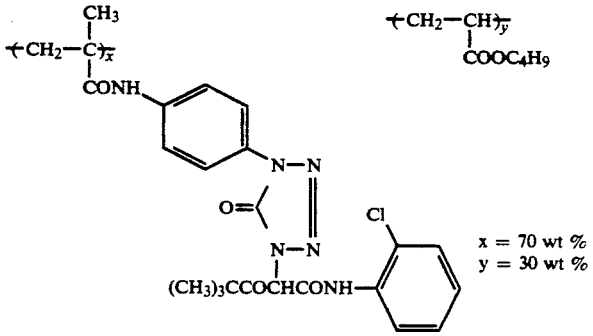
Dye donating substance (3)
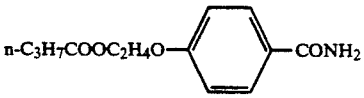
Thermal solvent
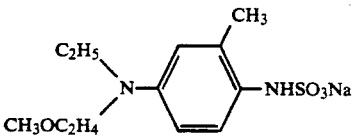
Reducing agent-1
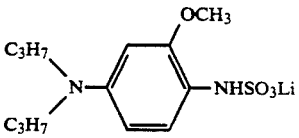
Reducing agent-2
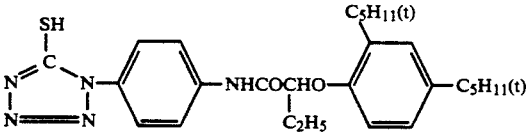
Antifoggant-1
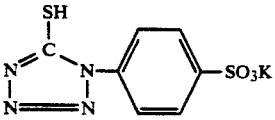
Antifoggant-2
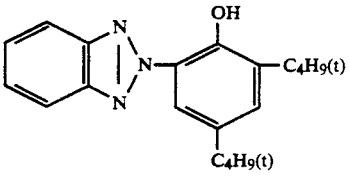
UV absorbent-1

-continued

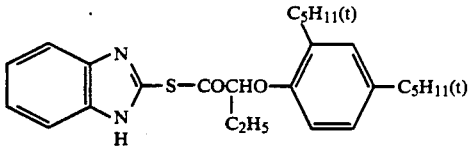

DAP-1

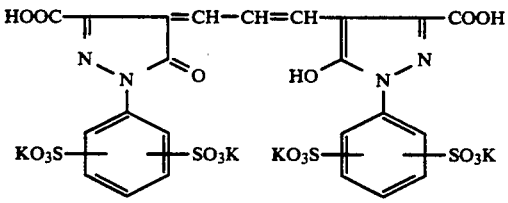

Anti-irradiation dye-1

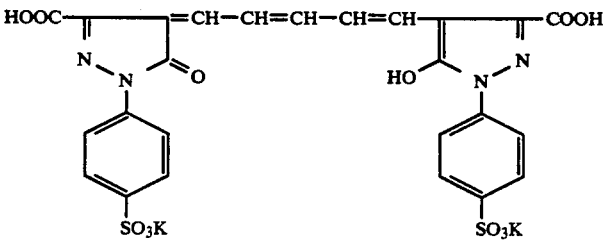

Anti-irradiation dye-2

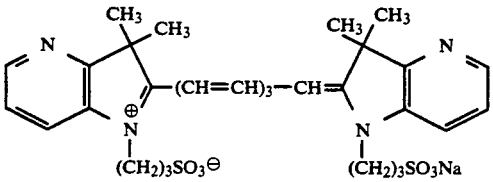

Anti-irradiation dye-3

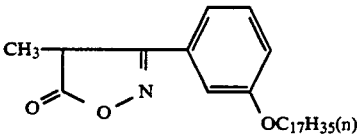

Antistain agent W-1

Di-(2-ethylhexyl)phthalate

DOP

TABLE 2

| | |
|---|---|
| Protective layer | Gelatin 1.0 g, silica powder 0.1 g, thermal solvent 0.8 g UV absorbent-1 0.2 g, DOP 0.15 g, zinc sulfate 0.28 g, reducing agent-1 0.2 g, reducing agent-2 0.1 g, PVP 0.21 g, antifoggant-1 0.026 |
| Infrared-sensitive layer | Infrared-sensitive silver iodobromide emulsion (Em-1) 0.31 g, reducing agent-1 0.3 g, gelatin 1.62 g, silver benzotriazole 0.43 g, dye nonating substance (1) 1.16 g, PVP 0.13 g, thermal solvent 1.8 g, DOP 0.48 g, antifoggant-1 0.042 g, antifoggant-2 0.01 g, antistain agent 0.22 g, benzotriazole 0.009 g, anti-irradiation dye-3 0.05 g, DAP-1 0.02 g |
| Intermediate layer | Gelatin 1.12 g, thermal solvent 1.01 g, reducing agent-1 0.35 g, reducing agent-2 0.12 g, UV absorbent 0.30 g, DOP 0.1 g. |
| Green-sensitive layer | Green-sensitive silver iodobromide emulsion (Em-2) 0.21 g, silver benzotriazole 0.12 g, gelatin 1.32 g, reducing agent-1 0.24 g, dye donating substance (2) 0.8 g, anti -irradiation-1 0.04 g, thermal solvent 1.6 g, PVP 0.12 g, NaBr 0.0012 g, benzotriazole 0.0018 g, antifoggant-1 0.08 g, antistain agent 0.08 g, DOP 0.3 g, DAP-1 0.02 g. |
| Intermediate layer | Gelatin 1.2 g, thermal solvent 1.28 g, reducing agent-1 0.2, reducing agent-2 0.1 g, UV absorbent-1 0.3 g, DOP 0.1 g, antifoggant-1 0.03 g, PVP 0.16 g, zinc sulfate 0.19 g |
| Red-sensitive layer | Red-sensitive silver iodobromide emulsion (Em-3) 0.39 g, silver benzotriazole 0.42 g, gelatin 1.43 g, reducing agent-1 0.28 g, dye donating substance (3) 1.18 g, thermal solvent 2.4 g, PVP 0.11 g, anti-irradiation dye-2 0.06 g, NaBr 0.0012 g, benzotriazole 0.0096 g, antifoggant-1 0.039 g, antistain agent 0.1 g, DOP 0.3 g, DAP-1 0.03 g |
| Support | 180 μm-thick polyethylene terephthalate film subbed on both sides. |
| Backing layer-1 | Black colloidal silver 0.36 g, gelatin 3.2 g |
| Backing layer-2 | Gelatin 1.2 g, matting agent (silica powder) 0.02 g |

*In the table, addition amounts are shown by a value per square meter of heat developing light-sensitive material, amounts of light-sensitive silver halide emulsions and silver benzotriazole are shown by values converted into silver.

*In the table, each structural layer was hardened by adding 0.03 g per gram gelatin of hardener-1.

TABLE 3

| Image receiving material | Peeling property | Number of unevenly developed spots | Maximum density | Minimum density |
|---|---|---|---|---|
| 1 (Invention) | a | 156 | B 2.29 | B 0.11 |

TABLE 3-continued

| Image receiving material | Peeling property | Number of unevenly developed spots | Maximum density | Minimum density |
|---|---|---|---|---|
| | | | G 2.39 | G 0.09 |
| | | | R 2.44 | R 0.06 |
| 2 (Comparison) | | Immeasurable | Immeasurable | Immeasurable |
| 3 (Comparison) | | Immeasurable | Immeasurable | Immeasurable |
| 4 (Comparison) | c | 22 | B 1.56 | B 0.06 |
| | | | G 1.89 | G 0.04 |
| | | | R 1.92 | R 0.02 |
| 5 (Invention) | b | 9 | B 1.97 | B 0.09 |
| | | | G 2.26 | G 0.08 |
| | | | R 2.32 | R 0.05 |
| 6 (Invention) | a | 4 | B 2.21 | B 0.09 |
| | | | G 2.34 | G 0.09 |
| | | | R 2.47 | R 0.06 |
| | | | B 2.21 | B 0.09 |
| 7 (Invention) | a | 1 | B 2.21 | B 0.09 |
| | | | G 2.34 | G 0.09 |
| | | | R 2.47 | R 0.06 |
| 8 (Invention) | a | 1 | B 2.31 | B 0.11 |
| | | | G 2.47 | G 0.10 |
| | | | R 2.46 | R 0.07 |
| 9 (Invention) | a | 2 | B 2.32 | B 0.11 |
| | | | G 2.44 | G 0.12 |
| | | | R 2.50 | R 0.10 |
| 10 (Invention) | a | 13 | B 2.37 | B 0.12 |
| | | | G 2.45 | G 0.12 |
| | | | R 2.52 | R 0.10 |
| 11 (Comparison) | a | 87 | B 2.37 | B 0.12 |
| | | | G 2.48 | G 0.12 |
| | | | R 2.56 | R 0.11 |

It is understood from the results shown in Table 3 that image receiving materials 1 and 11 having image receiving layers composed only of polyvinyl chloride are excellent in peeling property and high in dye receiving capability (high maximum densities) but are liable to cause unevenly developed spots on the image receiving layers. And image receiving materials 2 and 3 having an image receiving layer consisting of gelatin and mordant-1 (containing no polyvinyl chloride latex) are poor in peeling property after heat development. Further, image receiving material 4, which contains a polyvinyl chloride latex but the amount is smaller than the value specified in the invention, is insufficient in peeling property after heat development.

On the contrary, image receiving materials 5 to 10 of the invention have good peeling properties after heat development, in addition to less uneven developing and capabilities of providing a high maximum density. Particularly, image receiving materials having a gelatin to polymer latex ratio of 1:1 to 1:10 are excellent in peeling property and as well as extremely low in uneven developing.

Example 2

Image receiving materials 12 to 36 were prepared as in Example 1, by changing the polyvinyl chloride latex (glass transition point Tg=110° C.) used in image receiving materials 3 to 11 of Example 1 to ones having Tgs of 85° C., 55° C., 45° C. and 25° C., respectively (addition amounts of gelatin and polyvinyl chloride lattices are shown in Table 4).

The peeling property from the light-sensitive material, uneven developing, and maximum density and minimum density were evaluated on each image receiving material, in the same manner as in Example 1. The results are shown in Table 4.

Separately, each image receiving material was evaluated for the sticking property in preservation by piling up 50 sheets of the material and storing the pile for 3 days. at 40° C. and 65% RH under a load of 0.5 kg/cm2. The results are shown in Table 5. Criteria for rating the sticking property a: An image receiving material is easily peelable, and no sticking is left at all.

b: A sound is generated when an image receiving material is peeled off, but no sticking mark is left.

c: Sticking marks are left after peeling, and an image receiving layer is partly taken away by the reverse side of the adjacent image receiving material.

TABLE 4

| Image receiving material | Gelatin | Polymer latex Tg (°C.) | Polymer latex Amount used (g/m²) | Peeling property | Unevenly developed spots | Photographic properties Maximum density B | Maximum density G | Maximum density R | Minimum density B | Minimum density G | Minimum density R | Sticking property |
|---|---|---|---|---|---|---|---|---|---|---|---|---|
| 12 | 6 | 85 | 6 | a | 3 | 2.26 | 2.38 | 2.50 | 0.10 | 0.09 | 0.06 | a |
| 13 | 4 | 85 | 8 | a | 2 | 2.33 | 2.40 | 2.51 | 0.11 | 0.09 | 0.06 | a |
| 14 | 2 | 85 | 10 | a | 2 | 2.35 | 2.39 | 2.55 | 0.10 | 0.09 | 0.07 | a |
| 15 | 1.2 | 85 | 10.8 | a | 1 | 2.31 | 2.42 | 2.50 | 0.11 | 0.09 | 0.07 | a |
| 16 | 6 | 55 | 6 | b | 1 | 2.30 | 2.45 | 2.56 | 0.10 | 0.10 | 0.07 | a |
| 17 | 4 | 55 | 8 | a | 2 | 2.32 | 2.41 | 2.54 | 0.11 | 0.10 | 0.08 | a |
| 18 | 2 | 55 | 10 | a | 3 | 2.34 | 2.45 | 2.57 | 0.11 | 0.09 | 0.08 | a |
| 19 | 1.2 | 55 | 10.8 | a | 2 | 2.33 | 2.47 | 2.53 | 0.11 | 0.10 | 0.07 | b |
| 20 | 6 | 45 | 6 | b | 3 | 2.41 | 2.51 | 2.60 | 0.11 | 0.10 | 0.08 | a |
| 21 | 4 | 45 | 8 | b | 2 | 2.45 | 2.55 | 2.58 | 0.11 | 0.11 | 0.09 | a |
| 22 | 2 | 45 | 10 | a | 3 | 2.44 | 2.53 | 2.54 | 0.11 | 0.10 | 0.08 | a |
| 23 | 1.2 | 45 | 10.8 | a | 2 | 2.42 | 2.55 | 2.57 | 0.12 | 0.11 | 0.08 | b |
| 24 | 6 | 25 | 6 | b | 1 | 2.44 | 2.52 | 2.56 | 0.11 | 0.11 | 0.09 | a |
| 25 | 4 | 25 | 8 | b | 2 | 2.45 | 2.53 | 2.53 | 0.12 | 0.11 | 0.09 | a |
| 26 | 2 | 25 | 10 | b | 2 | 2.43 | 2.51 | 2.54 | 0.12 | 0.10 | 0.09 | b |
| 27 | 1.2 | 25 | 10.8 | a | 1 | 2.47 | 2.56 | 2.55 | 0.12 | 0.11 | 0.09 | c |

As apparent from Table 4, the image receiving materials containing a polyvinyl chloride latex in an amount specified in the invention are good in peeling property after heat developing, less in causing uneven developing and high in capability of providing a high maximum density, like the results in Example 1. It is also found that the peeling property between the light-sensitive material and image receiving material after heat developing changes as the glass transition point (Tg) of the polymer latex decreases, and that a particularly good peeling property is obtained at a Tg of 30° C. and above, preferably 50° C. and above, especially 80° C. and above.

On the other hand, it is apparent that the sticking property of image receiving material in storing depends upon the glass transition point (Tg) of the polyvinyl chloride, and a good preservability is obtained when the Tg higher is 30° C. and above, preferably 50° C. and above, especially 80° C. and above.

Example 3

Image receiving materials 28 to 42 were prepared in a manner similar to that in Example 1, by changing the polyvinyl chloride latex (glass transition point Tg=110° C.) used in image receiving materials 3 to 11 of Example 1 to polyester lattices respectively having Tgs of 110° C., 70° C. and 27° C. (addition amounts of gelatin and polyester lattices are shown in Table 5).

As a comparative image receiving material, image receiving material 43 was prepared in the same manner as in image receiving material 1 of Example 1, except that the polyvinyl chloride latex was replace with a non-latex polyester (glass transition point Tg=115° C.).

The peeling property after heat developing, eneven developing, maximum density and minimum density, and sticking property after preservation were evaluated. The evaluation results are shown in Table 5.

TABLE 5

| Image receiving material | Gelatin | Polymer latex Tg (°C.) | Polymer latex Amount used (g/m²) | Peeling property | Unevenly developed spots | Photographic properties Maximum density B | Maximum density G | Maximum density R | Minimum density B | Minimum density G | Minimum density R | Sticking property |
|---|---|---|---|---|---|---|---|---|---|---|---|---|
| 28 | 9 | 115 | 3 | c | 23 | 2.09 | 2.11 | 2.12 | 0.08 | 0.10 | 0.11 | a |
| 29 | 6 | 115 | 6 | a | 4 | 2.33 | 2.42 | 2.58 | 0.12 | 0.10 | 0.06 | a |
| 30 | 3 | 115 | 9 | a | 1 | 2.40 | 2.42 | 2.51 | 0.11 | 0.10 | 0.08 | a |
| 31 | 1.2 | 115 | 10.8 | a | 1 | 2.38 | 2.47 | 2.52 | 0.11 | 0.09 | 0.07 | a |
| 32 | 1 | 115 | 11 | a | 4 | 2.32 | 2.46 | 2.47 | 0.11 | 0.11 | 0.08 | a |
| 33 | 9 | 70 | 3 | c | 38 | 2.16 | 2.18 | 2.20 | 0.09 | 0.09 | 0.07 | a |
| 34 | 6 | 70 | 6 | a | 6 | 2.34 | 2.48 | 2.55 | 0.11 | 0.09 | 0.09 | a |
| 35 | 3 | 70 | 9 | a | 3 | 2.37 | 2.49 | 2.55 | 0.12 | 0.11 | 0.08 | a |
| 36 | 1.2 | 70 | 10.8 | a | 1 | 2.40 | 2.59 | 2.57 | 0.12 | 0.11 | 0.09 | a |
| 37 | 1 | 70 | 11 | a | 7 | 2.42 | 2.53 | 2.62 | 0.12 | 0.11 | 0.09 | b |
| 38 | 9 | 27 | 3 | c | 42 | 2.20 | 2.23 | 2.30 | 0.10 | 0.10 | 0.07 | a |
| 39 | 6 | 27 | 6 | b | 2 | 2.43 | 2.57 | 2.59 | 0.11 | 0.12 | 0.09 | a |
| 40 | 3 | 27 | 9 | a | 6 | 2.47 | 2.55 | 2.58 | 0.11 | 0.11 | 0.09 | a |
| 41 | 1.2 | 27 | 10.8 | a | 3 | 2.46 | 2.58 | 2.61 | 0.12 | 0.11 | 0.09 | b |
| 42 | 1 | 27 | 11 | a | 8 | 2.47 | 2.57 | 2.55 | 0.12 | 0.12 | 0.09 | c |
| 43 | — | — | — | a | 98 | 2.41 | 2.52 | 2.59 | 0.12 | 0.11 | 0.09 | a |

It is understood from Table 5 that the image receiving materials containing a polyester latex in an amount specified in the invention are good in peeling property after heat developing, less in causing uneven developing and capable of providing a high maximum density. It is also understood that the peeling property of the light-sensitive material and image receiving material after heat developing changes as the glass transition point (Tg) of the polymer latex decreases, and that a Tg higher than 70° C. provides a good peeling property after heat developing and causes little stickiness in storing.

Example 4

Image receiving materials were prepared by varying, as shown in Table 6, types and addition amounts of the high boiling organic solvent used in image receiving material 8 of Example 1. In preparing the image receiving materials, a 100-μm-thick transparent subbed polyethylene terephthalate support was used. The above high boiling organic solvents were each dispersed together with dye image stabilizer 1, 2 or 3 in an aqueous gelatin solution before use.

The image receiving materials prepared as above were evaluated for the peeling property after heat developing, uneven developing, photographic properties, and sticking property in the same manner as in Example 2. The results are shown in Table 6.

Further, these image receiving materials were visually checked for devitrification after heat developing, as the results are shown in Table 6. Ratings of the devitrification are as follows:

| | |
|---|---|
| No devitrification | a |
| Slight devitrification | b |
| Overall devitrification | c |

It is apparent from the results shown in Table 6 that the image receiving materials of the invention do not lower their peeling properties and maintain good characteristics with respect to uneven developing and photographic properties, even when a high boiling organic solvent is added in their image receiving layers. On the other hand, addition of a high boiling organic solvent substantially improves the devitrification and thereby provides tratransferred images of high sharpness and transparency.

TABLE 6

| Image receiving material | High boiling organic solvent Type | High boiling organic solvent Amount added (g/m²) | Peeling property | Unevenly developed spots | Devitrification | Photographic properties Maximum density B | Maximum density G | Maximum density R | Minimum density B | Minimum density G | Minimum density R | Sticking property |
|---|---|---|---|---|---|---|---|---|---|---|---|---|
| 8 | — | — | a | 2 | c | 1.32 | 1.39 | 1.44 | 0.06 | 0.06 | 0.03 | a |
| 44 | HB-1 | 2 | a | 2 | a | 1.30 | 1.37 | 1.42 | 0.06 | 0.06 | 0.03 | a |
| 45 | HB-4 | 2 | a | 2 | a | 1.31 | 1.40 | 1.44 | 0.06 | 0.06 | 0.02 | a |
| 46 | HB-7 | 0.1 | a | 3 | b | 1.29 | 1.40 | 1.46 | 0.07 | 0.05 | 0.03 | a |
| 47 | HB-7 | 0.5 | a | 2 | a | 1.32 | 1.41 | 1.47 | 0.06 | 0.06 | 0.03 | a |
| 48 | HB-7 | 2 | a | 2 | a | 1.30 | 1.42 | 1.50 | 0.06 | 0.06 | 0.04 | a |
| 49 | HB-7 | 5 | a | 1 | a | 1.31 | 1.44 | 1.49 | 0.07 | 0.05 | 0.03 | a |
| 50 | HB-7 | 7 | a | 0 | a | 1.34 | 1.48 | 1.52 | 0.07 | 0.06 | 0.04 | b |
| 51 | HB-11 | 2 | a | 0 | a | 1.33 | 1.41 | 1.47 | 0.05 | 0.05 | 0.03 | a |

TABLE 6-continued

| Image receiving material | High boiling organic solvent Type | Amount added ($g/m^2$) | Peeling property | Unevenly developed spots | Devitrification | Photographic properties Maximum density B | G | R | Minimum density B | G | R | Sticking property |
|---|---|---|---|---|---|---|---|---|---|---|---|---|
| 52 | HB-22 | 2 | a | 2 | a | 1.32 | 1.46 | 1.52 | 0.06 | 0.06 | 0.03 | a |
| 53 | HB-24 | 2 | a | 1 | a | 1.29 | 1.40 | 1.47 | 0.06 | 0.06 | 0.03 | a |
| 54 | HB-29 | 2 | a | 1 | a | 1.33 | 1.41 | 1.53 | 0.06 | 0.06 | 0.03 | a |
| 55 | HB-31 | 2 | a | 0 | a | 1.30 | 1.42 | 1.46 | 0.06 | 0.06 | 0.03 | a |
| 56 | HB-33 | 2 | a | 0 | a | 1.29 | 1.41 | 1.48 | 0.06 | 0.06 | 0.03 | a |

Example 5

A transfer recording test was conducted on image receiving materials 1 to 43 used in Examples 1 to 3, using sublimation-type ink sheets.

Preparation of ink sheets

Using the following colorants, ink compositions of yellow, magenta and cyan were prepared according to the method described in Japanese Pat. O.P.I. Pub. No. 229789/1985. These ink compositions were printed on a 6-m-thick subbed polyethylene terephthalate film support in the order of yellow, magenta and cyan to prepare a sublimation type ink composition.

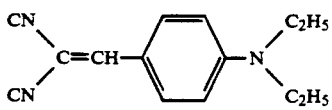

Yellow

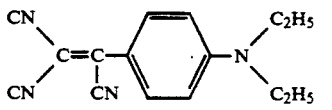

Magenta

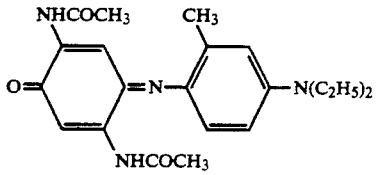

Cyan

The heat transfer recording was conducted using the above ink sheet and dye image receiving materials 1 to 43, at a recording speed of 30 msec/dot with a thermal head of 8 dpm (recording size: 10 cm × 8 cm).

Evaluation of image receiving materials

The maximum densities (blue, green and red) of dye images formed on the image receiving materials and the frequency of sticking between the ink sheet and the image receiving material (the number of sticking times in 20 sheets) were measured. The results are shown in Table 7.

TABLE 7

| Image receiving material | Number of sticking times | Maximum densities B | G | R |
|---|---|---|---|---|
| 1 (Comparison) | 36 | 2.03 | 2.12 | 2.14 |
| 2 (Comparison) | 2 | 0.85 | 0.72 | 0.58 |
| 3 (Comparison) | 1 | 0.93 | 0.98 | 0.84 |
| 4 (Comparison) | 1 | 1.02 | 1.20 | 1.25 |
| 5 (Invention) | 2 | 1.78 | 1.95 | 1.92 |
| 6 (Invention) | 1 | 2.01 | 2.07 | 2.12 |
| 7 (Invention) | 2 | 2.12 | 2.20 | 2.28 |
| 8 (Invention) | 2 | 2.19 | 2.25 | 2.32 |

TABLE 7-continued

| Image receiving material | Number of sticking times | Maximum densities B | G | R |
|---|---|---|---|---|
| 9 (Invention) | 4 | 2.20 | 2.28 | 2.34 |
| 10 (Invention) | 7 | 2.26 | 2.32 | 2.38 |
| 11 (Comparison) | 39 | 2.31 | 2.35 | 2.46 |
| 12 (Invention) | 2 | 2.24 | 2.31 | 2.32 |
| 13 (Invention) | 3 | 2.29 | 2.38 | 2.48 |
| 14 (Invention) | 3 | 2.35 | 2.45 | 2.52 |
| 15 (Invention) | 6 | 2.42 | 2.45 | 2.53 |
| 16 (Invention) | 3 | 2.31 | 2.38 | 2.48 |
| 17 (Invention) | 3 | 2.34 | 2.41 | 2.49 |
| 18 (Invention) | 4 | 2.40 | 2.45 | 2.58 |
| 19 (Invention) | 7 | 2.43 | 2.56 | 2.58 |
| 20 (Invention) | 4 | 2.32 | 2.38 | 2.48 |
| 21 (Invention) | 4 | 2.38 | 2.45 | 2.52 |
| 22 (Invention) | 5 | 2.41 | 2.47 | 2.53 |
| 23 (Invention) | 7 | 2.44 | 2.47 | 2.53 |
| 24 (Invention) | 5 | 2.39 | 2.48 | 2.59 |
| 25 (Invention) | 7 | 2.42 | 2.51 | 2.53 |
| 26 (Invention) | 7 | 2.44 | 2.49 | 2.59 |
| 27 (Invention) | 9 | 2.48 | 2.51 | 2.56 |
| 28 (Comparison) | 3 | 1.01 | 0.85 | 0.93 |
| 29 (Invention) | 3 | 1.68 | 1.51 | 1.59 |
| 30 (Invention) | 3 | 1.95 | 1.78 | 1.86 |
| 31 (Invention) | 4 | 2.02 | 1.95 | 1.91 |
| 32 (Invention) | 8 | 2.03 | 1.99 | 2.02 |
| 33 (Comparison) | 3 | 1.17 | 1.02 | 1.21 |
| 34 (Invention) | 4 | 1.78 | 1.71 | 1.68 |
| 35 (Invention) | 4 | 1.97 | 2.02 | 2.08 |
| 36 (Invention) | 6 | 2.03 | 2.13 | 2.11 |
| 37 (Invention) | 9 | 2.11 | 2.16 | 2.14 |
| 38 (Comparison) | 4 | 1.21 | 1.09 | 1.30 |
| 39 (Invention) | 5 | 1.85 | 1.81 | 1.76 |
| 40 (Invention) | 5 | 2.01 | 2.07 | 2.12 |
| 41 (Invention) | 6 | 2.10 | 2.16 | 2.20 |
| 42 (Invention) | 8 | 2.14 | 2.21 | 2.23 |
| 43 (Comparison) | 49 | 2.13 | 2.28 | 2.30 |

It can be seen in Table 7 that the image receiving materials containing the hydrophilic binder and polymer latex of the invention in amounts specified in the invention are high in maximum densities and less liable to cause sticking to an ink sheet.

Example 6

Dye image receiving materials 57 to 64 were prepared using a polyvinyl chloride powder dispersion prepared by dispersing the following composition with a ball mill, instead of the polyvinyl chloride latex in image receiving materials 4 to 11 prepared in Example 1. Then, these were subjected to evaluation in the same manner as in Example 1. Composition of the dispersion

| | |
|---|---|
| Polyvinyl chloride powder (product of Shin-Etsu Chemical) | 25 g |
| Polyvinylpyrrolidone | 0.3 g |
| Water | 80 ml |
| Sodium tripropylnaphthalenesulfonate | 1.0 g |

The evaluation results are shown in Table 8.

TABLE 8

| Image receiving material | Gelatin ($g/m^2$) | Polyvinyl chloride particles ($g/m^2$) | Peeling property | Number of unevenly developed spots | Maximum density | | | Minimum density | | |
|---|---|---|---|---|---|---|---|---|---|---|
| | | | | | B | G | R | B | G | R |
| 57 (Comparison) | 9 | 3 | c | 41 | 1.01 | 1.06 | 1.42 | 0.03 | 0.02 | 0.01 |
| 58 (Invention) | 7 | 5 | b | 18 | 1.63 | 1.61 | 1.79 | 0.03 | 0.04 | 0.01 |
| 59 (Invention) | 6 | 6 | a | 7 | 1.86 | 1.94 | 2.17 | 0.05 | 0.05 | 0.02 |
| 60 (Invention) | 4 | 8 | a | 5 | 2.11 | 2.18 | 2.31 | 0.07 | 0.08 | 0.04 |
| 61 (Invention) | 2 | 10 | a | 3 | 2.15 | 2.20 | 2.40 | 0.09 | 0.09 | 0.05 |
| 62 (Invention) | 1.2 | 10.8 | a | 3 | 2.24 | 2.31 | 2.36 | 0.09 | 0.09 | 0.06 |
| 63 (Invention) | 0.6 | 11.4 | a | 10 | 2.25 | 2.36 | 2.42 | 0.11 | 0.10 | 0.06 |
| 64 (Comparison) | 0 | 12 | a | 34 | 2.31 | 2.43 | 2.44 | 0.11 | 0.11 | 0.06 |

As apparent from the results in Table 8, the effect of the invention, namely a good peeling property and less liability to uneven developing, can be seen in image receiving materials 58 to 63 of the invention, even when the polyvinyl chloride latex in the image receiving layer is changed to mechanically pulverized polyvinyl chloride particles.

Example 7

As comparative samples, image receiving materials 1 and 2 of Example 1 were prepared. Next, dye image receiving materials 65 to 95 were prepared by forming, on a photographic baryta paper, a dye image receiving layer consisting of polyvinyl chloride latex (glass transition point Tg=110° C.), gelatin and exemplified hardener H-12 as shown in Table 9. There were further added, in the dye image receiving layers of dye image receiving materials 65 to 95, image stabilizers -1, -2, -3 and -4 and developing accelerator -1 in amounts equal to those used in dye image receiving material 2. (Coating was made in the same manner as in dye image receiving material 2.)

The dye image receiving materials obtained as above were preserved for 3 day at 35° C and 60% RH for layer hardening.

Evaluation of image receiving materials

After being conditioned for 2 hours at 25° C. and 55% RH, these image receiving materials were weighed ($W_1$ $g/m^2$). Next, they were immersed in water maintained at 30° C. for 2 minutes and taken out. After wiping off water attaching to the surface with filter papers, the image receiving materials were weighed again ($W_2$ $g/m^2$).

The amount of water absorption or degree of swell was determined by the following expression:

$$\text{Degree of swell (\%)} = 100 \times \frac{(W_2 - W_1)}{WB}$$

Wherein: WB: amount of hydrophilic binder contained in the image receiving layer of the above sample ($g/m^2$)

On the other hand, after wedge-exposing the heat developing color light-sensitive material to a white light, image receiving materials 1, 2 and 65 to 77 were superposed thereon. Then, heat developing was carried out under conditions of 150° C. and 75 sec, with a drum belt-type heat developing apparatus, so as to obtain continuously 10 developed images each of respective image receiving materials.

After cooling the samples to room temperature, the image receiving materials were peeled off from the light-sensitive material to evaluate the peeling property. The number of layer breaks and unevenly developed spots on the peeled image receiving materials were also counted. Separately, the reflective density (maximum density) of a dye image formed on the image receiving material was measured. The results are set forth in Table 9.

TABLE 9

| Image receiving material | Gelatin ($g/m^2$) | Amount of polymer latex ($g/m^2$) | Amount of hardener used (%)** | Degree of swell (%) | Peeling property | Number of unevenly developed spots | Photographic properties Maximum density | | |
|---|---|---|---|---|---|---|---|---|---|
| | | | | | | | B | G | R |
| 1 | 0 | 0 | — | — | a | 156 | 2.27 | 1.38 | 2.48 |
| 2 | 4 | 0 | 2.0 | 420 | d | Immeasurable | Immeasurable | | |
| 65 | 9 | 3 | — | (*) | c | 42 | 2.15 | 2.19 | 2.28 |
| 66 | 6 | 6 | — | (*) | c | 36 | 2.31 | 2.32 | 2.45 |
| 67 | 4 | 8 | — | (*) | c | 28 | 2.31 | 2.42 | 2.52 |
| 68 | 2 | 10 | — | (*) | b | 20 | 2.33 | 2.43 | 2.51 |
| 69 | 1 | 11 | — | (*) | b | 55 | 2.32 | 2.49 | 2.43 |
| 70 | 0 | 12 | — | (*) | a | 128 | 2.35 | 2.49 | 2.58 |
| 71 | 9 | 3 | 0.5 | 920 | c | 27 | 2.21 | 2.23 | 2.36 |
| 72 | 6 | 6 | 0.5 | 950 | c | 22 | 2.31 | 2.42 | 2.57 |
| 73 | 4 | 8 | 0.5 | 1020 | b | 16 | 2.34 | 2.38 | 2.52 |
| 74 | 2 | 10 | 0.5 | 1060 | a | 12 | 2.38 | 2.51 | 2.58 |
| 75 | 1 | 11 | 0.5 | 1100 | a | 24 | 2.40 | 2.50 | 2.57 |
| 76 | 9 | 3 | 1.0 | 620 | c | 15 | 2.15 | 2.32 | 2.32 |
| 77 | 6 | 6 | 1.0 | 650 | a | 6 | 2.37 | 2.49 | 2.59 |
| 78 | 4 | 8 | 1.0 | 690 | a | 2 | 2.38 | 2.49 | 2.52 |
| 79 | 2 | 10 | 1.0 | 710 | a | 3 | 2.33 | 2.48 | 2.60 |
| 80 | 1 | 11 | 1.0 | 720 | a | 5 | 2.32 | 2.51 | 2.62 |
| 81 | 9 | 3 | 2.0 | 420 | a | 8 | 2.25 | 2.33 | 2.41 |
| 82 | 6 | 6 | 2.0 | 450 | a | 0 | 2.34 | 2.48 | 2.52 |
| 83 | 4 | 8 | 2.0 | 490 | a | 0 | 2.37 | 2.46 | 2.58 |
| 84 | 2 | 10 | 2.0 | 520 | a | 0 | 2.32 | 2.45 | 2.62 |
| 85 | 1 | 11 | 2.0 | 580 | a | 1 | 2.34 | 2.32 | 2.58 |

TABLE 9-continued

| Image receiving material | Gelatin (g/m²) | Amount of polymer latex (g/m²) | Amount of hardener used (%)** | Degree of swell (%) | Peeling property | Number of unevenly developed spots | Photographic properties Maximum density B | G | R |
|---|---|---|---|---|---|---|---|---|---|
| 86 | 9 | 3 | 5.0 | 370 | b | 6 | 2.19 | 2.57 | 2.33 |
| 87 | 6 | 6 | 5.0 | 390 | a | 0 | 2.33 | 2.41 | 2.57 |
| 88 | 4 | 8 | 5.0 | 410 | a | 0 | 2.37 | 2.49 | 2.57 |
| 89 | 2 | 10 | 5.0 | 425 | a | 0 | 2.42 | 2.57 | 2.62 |
| 90 | 1 | 11 | 5.0 | 450 | a | 0 | 2.40 | 2.53 | 2.58 |
| 91 | 9 | 3 | 10.0 | 340 | b | 4 | 2.25 | 2.33 | 2.37 |
| 92 | 6 | 6 | 10.0 | 360 | a | 1 | 2.41 | 2.49 | 2.56 |
| 93 | 4 | 8 | 10.0 | 380 | a | 0 | 2.46 | 2.58 | 2.63 |
| 94 | 2 | 10 | 10.0 | 400 | a | 0 | 2.44 | 2.57 | 2.60 |
| 95 | 1 | 11 | 10.0 | 420 | a | 0 | 2.45 | 2.55 | 2.59 |

*Immeasurable, because the layer disolved
**Wt % to gelatin

It is understood from Table 9 that image receiving material 70 whose image receiving layer is composed only of polyvinyl chloride is excellent in peeling property and high in dye image receiving capability (the highest maximum density) but liable to cause uneven developing on the dye image receiving layer. On the other hand, image receiving material 2 having an image receiving layer consisting of gelatin and mordant-1 (containing no polyvinyl chloride latex) is insufficient in peeling property after heat developing. Further, image receiving materials 65, 71, 76, 81, 86, 91 which contain a polyvinyl chloride latex but in amounts smaller than the value specified in the invention are also poor in peeling property.

Image receiving materials 3 to 13, which contain a polymer latex of the invention in amounts specified in the invention but whose degrees of swell at 30° C. are greater than 800%, are liable to cause layer breaking during heat developing and uneven developing such as uneven image transfer.

On the contrary, image receiving materials 77, 80, 82, 85, 87, 90, 92, 95 of the invention are good in peeling property, less in causing uneven developing and capable of providing high maximum densities. Particularly, image receiving materials 20 to 23, 25 to 28 and 30 to 33, of which degrees of swell are less than 600%, are good in peeling property and extremely low in uneven developing.

Example 8

Image receiving materials 96 to 115 shown in Table 10 were prepared by changing hardener H-12 used in image receiving material 74 prepared in Example 7 to hardeners H-1, H-5, H-16 and H-22. The degree of swell, peeling property, uneven developing and maximum density were evaluated on them. The result are set forth in Table 10.

It can be seen from the results shown in Table 10 that the image receiving materials of the invention having degree of swell of less than 800% have high performances in respect of peeling property and uneven developing.

TABLE 10

| Image receiving material | Hardener Compound | Amount used (%) | Degree of swell (%) | Peeling property | Number of unevenly developed spots | Photographic properties Maximum density B | G | R |
|---|---|---|---|---|---|---|---|---|
| 96 | H-1 | 0.5 | 870 | a | 10 | 2.39 | 2.46 | 2.60 |
| 97 | H-1 | 1 | 610 | a | 2 | 2.41 | 2.50 | 2.61 |
| 98 | H-1 | 2 | 400 | a | 0 | 2.42 | 2.52 | 2.59 |
| 99 | H-1 | 5 | 370 | a | 0 | 2.39 | 2.48 | 2.57 |
| 100 | H-1 | 10 | 350 | a | 0 | 2.37 | 2.46 | 2.59 |
| 101 | H-5 | 0.5 | 1150 | a | 21 | 2.33 | 2.47 | 2.58 |
| 102 | H-5 | 1 | 860 | a | 10 | 2.34 | 2.45 | 2.54 |
| 103 | H-5 | 2 | 720 | a | 3 | 2.41 | 2.52 | 2.62 |
| 104 | H-5 | 5 | 540 | a | 1 | 2.39 | 2.50 | 2.59 |
| 105 | H-5 | 10 | 420 | a | 0 | 2.37 | 2.48 | 2.60 |
| 106 | H-16 | 0.5 | 1120 | a | 16 | 2.35 | 2.44 | 2.54 |
| 107 | H-16 | 1 | 830 | a | 8 | 2.37 | 2.54 | 2.62 |
| 108 | H-16 | 2 | 670 | a | 2 | 2.40 | 2.52 | 2.61 |
| 109 | H-16 | 5 | 510 | a | 1 | 2.35 | 2.47 | 2.62 |
| 110 | H-16 | 10 | 450 | a | 0 | 2.36 | 2.48 | 2.58 |
| 111 | H-22 | 0.5 | 1100 | a | 18 | 2.35 | 2.45 | 2.56 |
| 112 | H-22 | 1 | 780 | a | 4 | 2.34 | 2.47 | 2.59 |
| 113 | H-22 | 2 | 650 | a | 2 | 2.33 | 2.55 | 2.61 |
| 114 | H-22 | 5 | 490 | a | 0 | 2.29 | 2.45 | 2.61 |
| 115 | H-22 | 10 | 435 | a | 0 | 2.33 | 2.47 | 2.57 |

Example 9

The procedure of Example 8 was repeated, except that a polyester (glass transition point Tg=115° C.) was used instead of the polyvinyl chloride.

The water absorption amount, peeling property, uneven developing and maximum density were measured in the same manner as in Example 8. The results are shown in Table 11.

As apparent from Table 11, the effect of the invention is also displayed even when polyvinyl chloride is used in the image receiving layer.

TABLE 11

| Image receiving material | Hardener Compound | Hardener Amount used (%) | Degree of swell (%) | Peeling property | Number of unevenly developed spots | Photographic properties Maximum density B | G | R |
|---|---|---|---|---|---|---|---|---|
| 116 | H-1 | 0.5 | 960 | a | 11 | 2.19 | 2.27 | 2.40 |
| 117 | H-1 | 1 | 715 | a | 3 | 2.21 | 2.30 | 2.47 |
| 118 | H-1 | 2 | 460 | a | 0 | 2.22 | 2.32 | 2.39 |
| 119 | H-1 | 5 | 400 | a | 0 | 2.19 | 2.28 | 2.37 |
| 120 | H-1 | 10 | 380 | a | 0 | 2.21 | 2.29 | 2.40 |
| 121 | H-3 | 0.5 | 1040 | a | 18 | 2.23 | 2.31 | 2.39 |
| 122 | H-3 | 1 | 820 | a | 11 | 2.18 | 2.29 | 2.37 |
| 123 | H-3 | 2 | 610 | a | 2 | 2.21 | 2.32 | 2.47 |
| 124 | H-3 | 5 | 490 | a | 0 | 2.21 | 2.32 | 2.44 |
| 125 | H-3 | 10 | 400 | a | 0 | 2.19 | 2.18 | 2.46 |
| 126 | H-12 | 0.5 | 1180 | a | 15 | 2.15 | 2.28 | 2.42 |
| 127 | H-12 | 1 | 880 | a | 10 | 2.26 | 2.34 | 2.44 |
| 128 | H-12 | 2 | 590 | a | 2 | 2.21 | 2.38 | 2.49 |
| 129 | H-12 | 5 | 400 | a | 0 | 2.18 | 2.29 | 2.41 |
| 130 | H-12 | 10 | 380 | a | 0 | 2.25 | 2.34 | 2.42 |
| 131 | H-16 | 0.5 | 1060 | a | 14 | 2.21 | 2.32 | 2.48 |
| 132 | H-16 | 1 | 720 | a | 3 | 2.22 | 2.31 | 2.46 |
| 133 | H-16 | 2 | 610 | a | 1 | 2.25 | 2.46 | 2.58 |
| 134 | H-16 | 5 | 470 | a | 0 | 2.19 | 2.33 | 2.48 |
| 135 | H-16 | 10 | 480 | a | 0 | 2.23 | 2.34 | 2.48 |

Example 10

In image receiving materials 68, 74, 79, 84, 89, 94 prepared in Example 7 (2 g of gelatin and 10 g of polymer latex were used), the polymer latex was changed to a dispersion obtained by dispersing a polyvinyl chloride powder for 72 hours with a ball mill in the following recipe, to prepare image receiving materials 136 to 141.

Ball mill dispersion recipe

| | |
|---|---|
| Polyvinyl chloride powder (product of Shin-Etsu Chemical) | 25 g |
| Polyvinylpyrrolidone | 0.3 g |
| Water | 80 ml |
| Sodium tripropylnaphthalenesulfonate | 1.0 g |

The water absorption amount, peeling property, uneven developing, photographic properties were measured in the same manner as in Example 1, as set forth in Table 12.

As shown in Table 12, image receiving materials of the invention having a water absorption amount less than 800% are high in peeling property and low in liability to uneven developing, even when using a mechanically pulverized polyvinyl chloride dispersion as polymer particles in the image receiving layer.

Example 11

Dye image receiving materials 142 to 148 were prepared by adding in image receiving material 89 of Example 7 the compounds shown in Table 13 as high boiling organic solvents. But, as a support for these materials, a 100-m-thick subbed transparent polyethylene terephthalate film was used.

The image receiving materials obtained were evaluated for the peeling property, uneven developing and photographic properties in the same manner as in Example 1. The results are shown in Table 13. Also, the devitrification after heat developing was visually examined on each image receiving material.

TABLE 12

| Image receiving material | Gelatin ($g/m^2$) | Polyvinyl chloride ($g/m^2$) | Hardener (%) | Degree of swell | Peeling property | Number of unevenly developed spots | Photographic properties B | G | R |
|---|---|---|---|---|---|---|---|---|---|
| 136 | 2 | 10 | 0 | (a) | b | 26 | 2.16 | 2.24 | 2.36 |
| 137 | 2 | 10 | 0.5 | 980 | a | 14 | 2.19 | 2.16 | 2.41 |
| 138 | 2 | 10 | 1.0 | 640 | a | 4 | 2.18 | 2.23 | 2.38 |
| 139 | 2 | 10 | 2.0 | 480 | a | 5 | 2.14 | 2.25 | 2.35 |
| 130 | 2 | 10 | 5.0 | 405 | a | 4 | 2.20 | 2.25 | 2.34 |
| 141 | 2 | 10 | 10.0 | 390 | a | 3 | 2.15 | 2.29 | 2.37 |

TABLE 13

| Image receiving material | High boiling organic solvent Compound | High boiling organic solvent Amount used ($g/m^2$) | Peeling property | Number of unevenly developed spots | Devitrification | Maximum density B | G | R |
|---|---|---|---|---|---|---|---|---|
| 142 | — | — | a | 4 | c | 1.19 | 1.25 | 1.29 |
| 143 | HB-11 | 2 | a | 4 | a | 1.24 | 1.36 | 1.34 |
| 144 | HB-20 | 2 | a | 3 | a | 1.25 | 1.33 | 1.34 |
| 145 | HB-25 | 2 | a | 3 | a | 1.27 | 1.37 | 1.35 |
| 146 | HB-26 | 2 | a | 4 | a | 1.25 | 1.30 | 1.36 |
| 147 | HB-30 | 2 | a | 3 | a | 1.33 | 1.34 | 1.33 |
| 148 | HB-33 | 2 | a | 4 | a | 1.31 | 1.36 | 1.41 |

As seen in Table 13, addition of a high boiling organic solvent prevents the devitrification.

What is claimed is:

1. A process of forming images comprising steps of exposing imagewise a heat-developable color light-sensitive material which comprises a support having thereon a light-sensitive layer containing a binder, light-sensitive silver halide emulsion and dye donating substance capable of forming or releasing a diffusible dye upon heat development; and, superposing a dye image receiving material which comprises a support having thereon a dye receiving layer, over the light-sensitive material during, or after completion of, heat development to transfer dye images to said dye image receiving layer; wherein said dye image receiving layer contains a hydrophilic binder and polymer particles; a weight ratio of said hydrophilic binder to said polymer particles is from 1:05 to 1:20, said polymer particles are polyvinyl chloride or a polyester; and the heat development and transfer of dye images to said dye image receiving layer are carried out in the substantial absence of water.

2. The method of claim 1, wherein said weight ratio is from 1:1 to 1:10.

3. The method of claim 1, wherein said polymer particles have a glass transition point of not lower than 40° C.

4. The method of claim 3, wherein said polymer particles are polyvinyl chloride.

5. The method of claim 1, wherein said image receiving layer contains a solvent having a boiling point of not lower than 170° C.

6. The process of claim 1 wherein said dye image receiving material comprises a support having thereon at least one dye image receiving layer containing at least a hydrophilic binder and polymer particles, wherein said polymer particles comprise a latex comprising polyvinyl chloride or a polyester;

said image receiving layer contains a hardener, and a solvent in an amount of 5 to 50% by weight to said polymer particles; and said image receiving layer has not more than 600% of degree of swell as defined as follows:

$$\text{Degree of swell} = 100 \times (W_A/W_B)$$

wherein $W_B$ represents an amount of the hydrophilic binder by weight per $m^2$ and $W_A$ represents an amount of water by weight per $m^2$ contained in the image receiving layer when said image receiving material is immersed in water maintained at 30° C.

7. A process of forming images comprising steps of exposing imagewise a heat-developable color light-sensitive material which comprises a support having thereon a light-sensitive layer containing a binder, light-sensitive silver halide emulsion and dye donating substance capable of forming or releasing a diffusible dye upon heat development and superposing a dye image receiving material which comprises a support having thereon a dye receiving layer, over the light-sensitive material during, or after completion of, heat development to transfer dye images to said dye image receiving layer; wherein said dye image receiving layer contains a hydrophilic binder and polymer particles, wherein said polymer particles comprises a latex comprising polyvinyl chloride or a polyester;

a weight ratio of said binder to said polymer particles is from 1:1 to 1:10, said image receiving layer contains a hardener, and a solvent in an amount of 5 to 50 % by weight to said polymer particles; and said image receiving layer has not more than 600 % of degree of swell as defined as follows:

$$\text{Degree of swell} = 100 \times (W_A/W_B)$$

wherein $W_B$ represents an amount of the hydrophiic binder by weight per $m^2$ and $W_A$ represents an amount of water by weight per $m^2$ contained in the image receiving layer when said image receiving material is immersed in water maintained at 30° C.

8. The method of claim 3 wherein said polymer particles are polyester.

9. The method of claim 6 wherein said polymer particles are polyvinyl chloride.

10. The method of claim 6 wherein said polymer particles are polyester.

11. The method of claim 7 wherein said polymer particles are polyvinyl chloride.

12. The method of claim 7 wherein said polymer particles are polyester.

* * * * *